US012405049B2

(12) United States Patent
Woo et al.

(10) Patent No.: US 12,405,049 B2
(45) **Date of Patent: *Sep. 2, 2025**

(54) REFRIGERATOR

(71) Applicant: LG ELECTRONICS INC., Seoul (KR)

(72) Inventors: Dongrim Woo, Seoul (KR); Sanghyun Cheon, Seoul (KR); Chanuk Kang, Seoul (KR); Changjae Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 321 days.

This patent is subject to a terminal disclaimer.

(21) Appl. No.: 18/023,057

(22) PCT Filed: Sep. 2, 2021

(86) PCT No.: PCT/KR2021/011834
§ 371 (c)(1),
(2) Date: Feb. 24, 2023

(87) PCT Pub. No.: WO2022/050714
PCT Pub. Date: Mar. 10, 2022

(65) Prior Publication Data

US 2023/0314062 A1 Oct. 5, 2023

(30) Foreign Application Priority Data

Sep. 2, 2020 (KR) ..... 10-2020-0111935

(51) Int. Cl.
*F25D 23/02* (2006.01)

(52) U.S. Cl.
CPC ..... *F25D 23/028* (2013.01); *F25D 2400/36* (2013.01)

(58) Field of Classification Search
CPC ... A47B 2096/208; A47B 96/20; F25D 23/02; F25D 23/028; F25D 2323/02;
(Continued)

(56) References Cited

U.S. PATENT DOCUMENTS 10,285,513 B2 5/2019 Lee
10,704,826 B2 7/2020 Lee et al.
(Continued)

FOREIGN PATENT DOCUMENTS

JP 2013-079805 A 5/2013
JP 5932630 B2 * 6/2016
(Continued)

OTHER PUBLICATIONS

Translation JP2019027759A (Year: 2019).*
(Continued)

*Primary Examiner* — Andrew Roersma
(74) *Attorney, Agent, or Firm* — KED & ASSOCIATES, LLP

(57) ABSTRACT

Provided is a refrigerator. The refrigerator includes a cabinet in which a storage space is defined and a door which is configured to open and close the storage space and into which an insulating material is filled. The door includes an outer plate which is configured to define a front surface of the door and in which an opening is defined, a panel assembly configured to shield the opening so that the inside of the door is seen therethrough, a supporter frame mounted on a rear surface of the outer plate and configured to support a circumference of the opening and a circumference of the panel assembly, and a display device which is mounted on the supporter frame in which a plurality of LEDs are continuously disposed on a substrate. A transmission portion through which light irradiated from the display is transmitted is provided in the display device.

19 Claims, 17 Drawing Sheets

(58) Field of Classification Search
CPC .. F25D 2400/18; F25D 2400/36; F25D 27/00; F25D 27/005
See application file for complete search history.

(56) References Cited

U.S. PATENT DOCUMENTS

| | | | | |
|---|---|---|---|---|
| 11,604,023 | B2 * | 3/2023 | Kang | F25D 27/005 |
| 11,859,901 | B2 * | 1/2024 | Kang | F25D 23/028 |
| 12,117,237 | B2 * | 10/2024 | Kang | F25D 23/025 |
| 2016/0003519 | A1 * | 1/2016 | Kim | F25D 29/005 49/70 |
| 2017/0059875 | A1 * | 3/2017 | Seung | G02B 27/144 |
| 2017/0191745 | A1 * | 7/2017 | Choi | A47F 3/0434 |
| 2017/0191746 | A1 * | 7/2017 | Seo | F25D 27/005 |
| 2017/0370636 | A1 * | 12/2017 | Koo | F25D 23/02 |
| 2018/0038627 | A1 * | 2/2018 | Kim | F25D 11/02 |
| 2018/0164031 | A1 * | 6/2018 | Lee | F25D 11/00 |
| 2018/0335252 | A1 * | 11/2018 | Oh | F25D 23/028 |
| 2018/0363970 | A1 * | 12/2018 | Koo | F25D 17/04 |
| 2019/0017679 | A1 * | 1/2019 | Choi | F21V 7/06 |
| 2019/0249485 | A1 * | 8/2019 | Jeong | F25D 29/005 |
| 2019/0257571 | A1 * | 8/2019 | Park | E06B 3/70 |
| 2019/0271500 | A1 * | 9/2019 | Lee | F25D 29/00 |
| 2019/0307263 | A1 * | 10/2019 | Lee | F25D 23/025 |
| 2021/0055038 | A1 * | 2/2021 | Lee | F25C 5/22 |
| 2021/0318061 | A1 * | 10/2021 | Lee | F25D 23/028 |
| 2021/0325104 | A1 * | 10/2021 | Kang | F25D 29/005 |
| 2021/0325107 | A1 * | 10/2021 | Kang | F25D 23/025 |
| 2023/0266057 | A1 * | 8/2023 | Kang | H04R 1/028 62/264 |
| 2023/0332822 | A1 * | 10/2023 | Kang | G06Q 30/015 |

FOREIGN PATENT DOCUMENTS

| | | | |
|---|---|---|---|
| JP | 2019-027759 | A | 2/2019 |
| KR | 10-2017-0031721 | A | 3/2017 |
| KR | 10-2018-0067360 | A | 6/2018 |
| KR | 10-2018-0067391 | A | 6/2018 |
| KR | 10-2019-0007891 | A | 1/2019 |

OTHER PUBLICATIONS

Translation KR20170031721A (Year: 2017).*
International Search Report (with English Translation) and Written Opinion dated Dec. 1, 2021 issued in Application No. PCT/KR2021/011834.

* cited by examiner

REFRIGERATOR

CROSS-REFERENCE TO RELATED PATENT APPLICATIONS

This application is a U.S. National Stage Application under 35 U.S.C. § 371 of PCT Application No. PCT/KR2021/011834, filed Sep. 2, 2021, which claims priority to Korean Patent Application No. 10-2020-0111935, filed Sep. 2, 2020, whose entire disclosures are hereby incorporated by reference.

TECHNICAL FIELD

The present disclosure relates to a refrigerator.

BACKGROUND ART

In general, a refrigerator is a home appliance for storing foods in an internal storage space, which is shielded by a door, at a low temperature by low temperature air. For this, the refrigerator is configured to accommodate the stored food in an optimum state by cooling the internal storage space using cold air generated through heat exchange with a refrigerant circulating in a refrigeration cycle.

In recent years, refrigerators have become increasingly multi-functional with changes of dietary lives and gentrification of products, and refrigerators having various structures and convenience devices for convenience of users and for efficient use of internal spaces have been released.

The storage space of the refrigerator may be opened/closed by the door. Also, refrigerators may be classified into various types according to an arranged configuration of the storage space and a structure of the door that opens and closes the storage space.

In general, the refrigerator has a problem in that when the door is not opened, internal food may not be identified. That is, the door should be opened to identify whether desired food is received in a space in the refrigerator or in a separate storage space provided in the door. Further, when a user does not exactly know where the food is stored, an opening time of the door may increase or the number of times the door is opened may increase. At this time, unnecessary outflow of cold air may occur.

In recent years, to solve such a limitation, a refrigerator has been developed while allows a portion of a door thereof to be transparent or allows the inside thereof to be visible from the outside.

In Korean Patent Publication No. 10-2018-0067391, a panel assembly through which the inside of a refrigerator is visible and on which a screen is output is provided on a door of the refrigerator. Also, a structure in which a screen is output by an operation of the panel assembly to transmit information through a see-through portion disposed on a front surface is disclosed.

However, in a refrigerator having the above-described structure, there are limitations in that an operation of a large-scale display is essential to transmit information, and the operation state is output, and the information is transmitted through only the output of the screen on the see-through area due to the operation of the display.

DISCLOSURE OF THE INVENTION

Technical Problem

Embodiments provide a refrigerator in which insulation performance of a door, in which a transmission portion that displays information is disposed, is secured.

Embodiments also provide a refrigerator in which a display device provided with a surface light-type transmission portion has a compact mounting structure inside a door.

Embodiments also provide a refrigerator in which a see-through portion that displays bar-shaped surface light is disposed in a panel assembly that sees through the inside of a door.

Technical Solution

In one embodiment, a refrigerator includes: a cabinet in which a storage space is defined; and a door which is configured to open and close the storage space and into which an insulating material is filled, wherein the door includes: an outer plate which is configured to define a front surface of the door and in which an opening is defined; a panel assembly configured to shield the opening so that the inside of the door is seen therethrough; a supporter frame mounted on a rear surface of the outer plate and configured to support a circumference of the opening and a circumference of the panel assembly; and a display device which is mounted on the supporter frame in which a plurality of LEDs are continuously disposed on a substrate, wherein a transmission portion through which light irradiated from the display is transmitted is provided in the display device.

In another embodiment, a refrigerator includes: a cabinet in which a storage space is defined; and a door which is configured to open and close the storage space and into which an insulating material is filled, wherein the door includes: an outer plate which is configured to define a front surface of the door and in which an opening is defined; a panel assembly configured to shield the opening so that the inside of the door is seen therethrough; a supporter frame mounted on a rear surface of the outer plate and configured to support a circumference of the opening and a circumference of the panel assembly; and a display device which is mounted on the supporter frame in which a plurality of LEDs are continuously disposed on a substrate, wherein a transmission portion through which light irradiated from the display is transmitted is provided in the display device, and, in the display device, the LEDs are disposed to be spaced apart from the transmission portion in a vertical direction and disposed to be inclined with respect to a front surface of the panel assembly to irradiate light toward the transmission portion.

In the display device, a normal line of a front surface of each of the LEDs may be mounted to pass through the transmission portion.

The LEDs may be spaced about 3 mm upward from each other based on a center of the transmission portion.

The base substrate may be arranged to have an angle of 15° with respect to the front surface of the panel assembly.

A display mounting portion recessed to accommodate the display device may be provided in the supporter frame, and the display mounting portion may be shielded by the panel assembly.

An inclined portion configured to protrude backward as the inclined portion extends downward may be disposed on the display mounting portion, and an inclination of the inclined portion may be greater than that of the substrate.

A vertical portion configured to extend up to a lower end of the display mounting portion may be disposed on a lower end of the inclined portion, and the vertical portion may extend parallel to a front surface of the panel assembly.

A support portion configured to support the substrate from a rear side may be disposed inside the display mounting portion, and the support portion may be provided in plurality at certain intervals.

The support portion may include: a rear support portion configured to support a rear surface of the substrate and provided to have an inclination that is equal to that of the substrate; an upper support portion configured to protrude forward from an upper end of the rear support portion so as to restrict an upper end of the substrate; and a lower support portion configured to protrude forward from a lower end of the rear support portion so as to support a lower end of the substrate.

A lower restriction portion, which protrudes upward and has a bent structure to be elastically deformed so as to press and fix a front surface of the substrate, may be disposed on the display mounting portion.

An upper restriction portion configured to protrude downward so as to restrict an upper end of the substrate may be disposed on the display mounting portion.

A coupling portion configured to protrude so as to support one end of the substrate from a rear side and configured to pass through a coupling hole of the substrate may be disposed on the display mounting portion.

A side restriction portion configured to protrude from an opposite side of the coupling portion and configured to restrict the other end of the substrate may be provided.

The front surface of the panel assembly may be made of a glass material, a bezel portion that is opaquely printed may be disposed on a rear surface of the front panel, and the transmission portion may be disposed on a partial area on which the bezel portion is not disposed.

The transmission portion may be shielded by a diffusion sheet configured to diffuse the light irradiated from the LEDs.

In further another embodiment, a refrigerator includes: a cabinet in which a storage space is defined; a main door which is configured to open and close the storage space and in which an opening is defined; and a sub door configured to open and close the opening at a front side of the main door, wherein the sub door includes: an outer plate which is configured to define a front surface of the door and in which an opening is defined; a panel assembly including a plurality of panels, which are configured to shield the opening and through which the inside of the door is seen therethrough, and a transparent display through which a screen is output; a supporter frame mounted on a rear surface of the outer plate and configured to support a circumference of the panel assembly; a display device which is mounted on the supporter frame in which a plurality of LEDs are continuously disposed on a substrate; and an insulating material configured to fill a space between the circumference of the panel assembly and the inside of the sub door, wherein a transmission portion through which light irradiated from the display is transmitted is provided in the display device, and, in the display device, the LEDs are disposed above the transmission portion and disposed to be inclined with respect to a front surface of the panel assembly to irradiate light toward the transmission portion.

The panel assembly may include: a front panel configured to define a front surface of the panel assembly and shield the opening; a rear panel spaced apart from the front panel to provide a space in which the display is disposed and configured to define a rear surface of the front panel; and an outer frame configured to connect the front panel to the rear panel and define a circumferential surface of the panel assembly, wherein the front panel may be larger than the rear panel so that a portion of the front panel protruding to the outside of the outer frame shields the display device at a front side.

A display mounting portion recessed to accommodate the display device may be provided in the supporter frame, and a rear surface of the front panel may be in contact with a front surface of the supporter frame so as to define a closed space in the display mounting portion.

The supporter frame may include a connector groove that is further recessed from the display mounting portion to accommodate a connector on the rear surface of the substrate, and a wire guide portion extending from the connector groove to the circumferential surface of the panel assembly and recessed to guide a wire connected to the connector, and the wire may extend up to an upper end of the door along a gap between the circumference of the panel assembly and the supporter frame.

The substrate may be disposed to be inclined backward as the substrate goes downward and may be mounted so that a normal line of a front surface of each of the LEDs has an inclination passing through the transmission portion.

The details of one or more embodiments are set forth in the accompanying drawings and the description below. Other features will be apparent from the description and drawings, and from the claims.

Advantageous Effects

The refrigerator and the refrigerator door according to the embodiment may have the following effects.

According to an embodiment, the display device may be disposed to be inclined toward the transmission portion at the position that is spaced vertically apart from the transmission portion. Thus, there may be the advantage in that the surface light having the sufficient brightness is realized without forming the spot-shaped light on the transmission portion while disposing the display device to be closer to the front panel.

Particularly, there may be the advantage in that the display device is disposed closer to the front panel to secure the insulating thickness inside the door, thereby securing the insulating performance. In addition, there may be the advantage in that the dew condensation is prevented from occurring on the surface of the door corresponding to the display mounting portion having the relatively thin insulating thickness due to the securing of the insulating performance.

In addition, there may be the advantage in that the more compact mounting structure is capable of being realized while realizing the surface light in the transmission portion due to the inclined arrangement structure of the display device.

In addition, there may be the advantage in that the structure of the support portion, the upper fixing portion, the lower fixing portion, the side fixing portion, and coupling portion are provided to maintain the inclined state of the substrate, thereby maintaining the state in which the substrate is firmly fixed inside the display mounting portion, and thus, the display device is maintained in its position even when the door is repeatedly opened and closed and is impacted.

In addition, there may be the advantage in that the transmission portion, which is displayed in the form of the surface light by the display device is disposed on the area adjacent to the see-through portion output on the screen by the display to transmit the information associated with the display or output the screen associated with the display, thereby enabling the more effective transmission.

In addition, there may be the advantage in that the transmission portion enables the operation state of the refrigerator and the information transmission by the independent operation regardless of the state of the see-through portion, thereby improving the convenience of use.

In addition, there may be the advantage in that the transmission portion is displayed in the form of the surface light having the high brightness to improve the visibility when the display device operates and also realizing the luxurious outer appearance.

BEST MODE FOR CARRYING OUT THE INVENTION

Hereinafter, detailed embodiments will be described in detail with reference to the accompanying drawings. However, the present disclosure is limited to the embodiments in which the spirit of the present invention is proposed, and other degenerate idea or other embodiments included in the scope of the present invention may be easily proposed by addition, changes, deletions, etc. of other elements.

Prior to a description, directions are defined. In an embodiment of the present disclosure, a direction facing a front surface of the door illustrated in FIG. 1 may be defined as a front direction, a direction facing a cabinet with respect to the front surface of the door will be defined as a rear direction, a direction facing a bottom surface on which the refrigerator is installed will be defined as a downward direction, and a direction that is away from the bottom surface will be defined as an upward direction.

Figure 1:
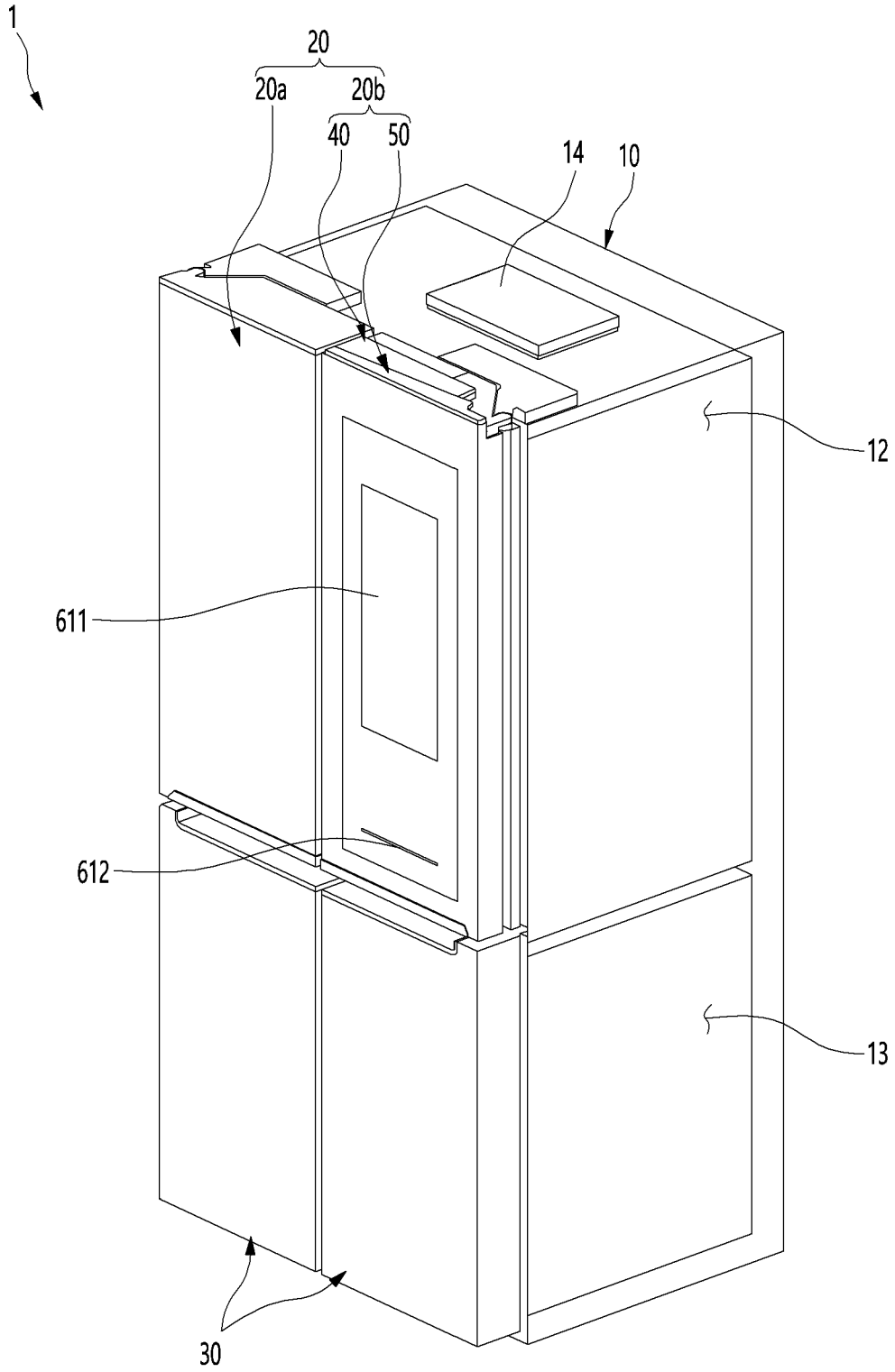
FIG. 1 is a perspective view of a refrigerator according to an embodiment.

FIG. 1 is a perspective view of a refrigerator according to an embodiment.

As illustrated in the drawings, an outer appearance of a refrigerator 1 according to an embodiment may be defined by a cabinet 10 defining a storage space and a door that opens and closes the storage space.

Figure 3:
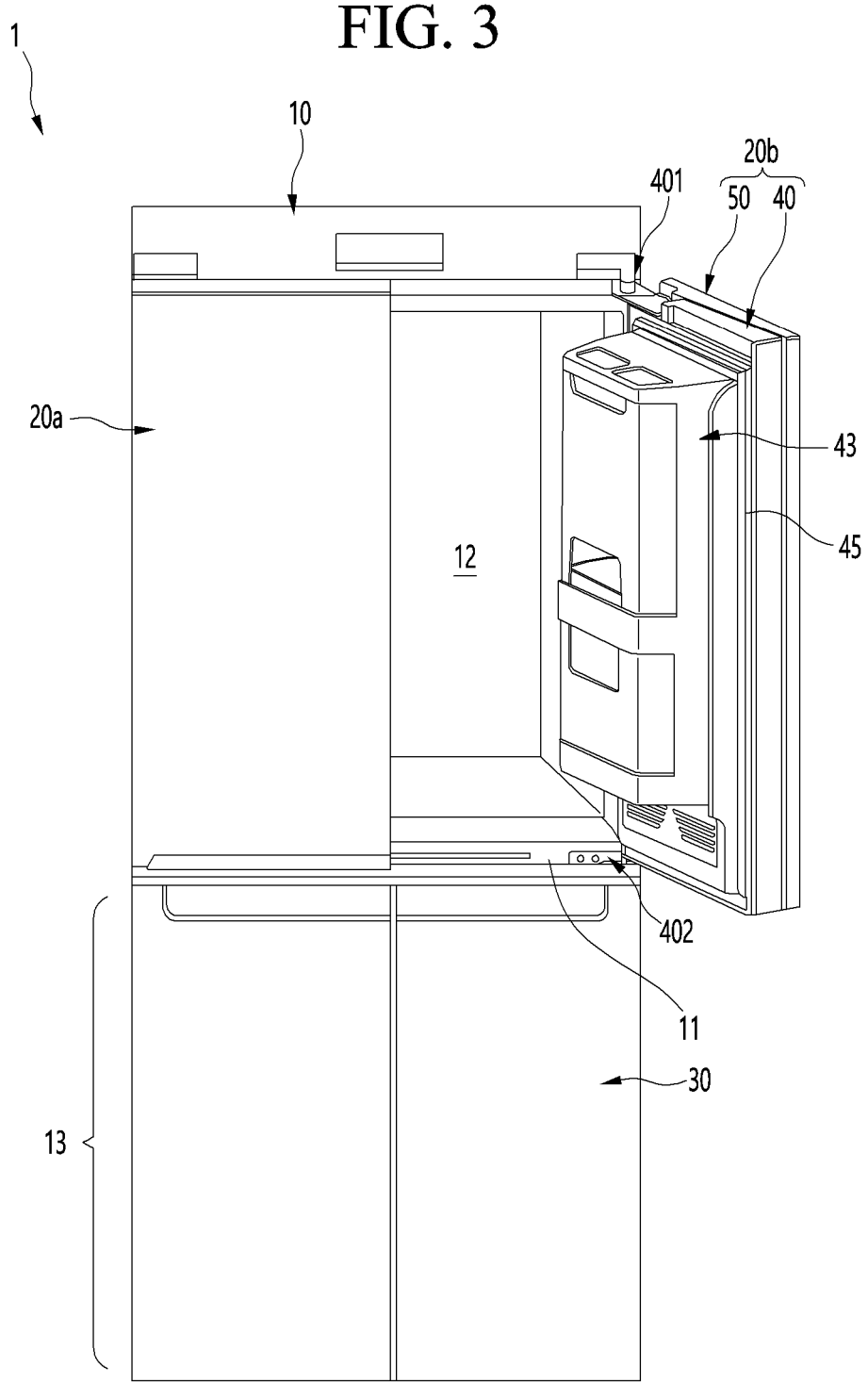
FIG. 3 is a perspective view illustrating a state in which a main door of the door of the refrigerator is opened.

The inside of the cabinet 10 is partitioned into upper and lower portions by a barrier 11 (see FIG. 3). A refrigerating compartment 12 may be defined in the upper portion of the cabinet 10, and a freezing compartment 13 may be defined in the lower portion of the cabinet 10.

Also, a controller 14 for controlling an overall operation of the refrigerator 1 may be disposed on a top surface of the cabinet 10. The controller 14 may be configured to control a cooling operation of the refrigerator as well as electric components for selective viewing and screen output of a see-through portion 611.

The door may include a refrigerating compartment door 20 and a freezing compartment door 30. The refrigerating compartment door 20 may be opened and closed by rotating an opened front surface of the refrigerating compartment 12, and the freezing compartment door 30 may be opened and closed by rotating an opened front surface of the freezing compartment 13. Also, the refrigerating compartment door 20 may be provided at an upper side and thus called an upper door, and the freezing compartment door 30 may be provided at a lower side and thus called a lower door.

Also, the refrigerating compartment door 20 may be provided in a pair of left and right doors. Thus, the refrigerating compartment 12 may be shielded by the pair of doors 20*a* and 20*b*. The freezing compartment door 30 may be provided in a pair of left and right doors. Thus, the freezing compartment 13 may be opened and closed by the pair of doors. Alternatively, the freezing compartment door 30 may be withdrawable in a draw type as necessary and provided as one or more doors.

Although a refrigerator in which, a French type door in which a pair of doors rotate to open and close one space is applied to a bottom freezer type refrigerator in which the freezing compartment 13 is provided at a lower portion, is described as an example in this embodiment, the present invention may be applied to all types of refrigerators including door without being limited to shapes of the refrigerators.

At least one door 20*b* of the pair of refrigerating compartment doors 20*a* and 20*b* may be provided to allow the inside of the refrigerator to be seen therethrough. A see-through portion 611, which is a storage space inside the refrigerating compartment door 20*b* or a region through which the storage space and/or a space inside the refrigerator are seen, may be provided in the refrigerating compartment door 20*b*. The see-through portion 611 may constitute at least a portion of a front surface of the refrigerating compartment door 20*b*. The see-through portion 611 may be selectively transparent or opaque according to user's manipulation. Thus, foods accommodated in the refrigerator may be identified through the see-through portion 611.

In addition, a transmission portion 612 displaying information related to an operation of the refrigerator 1 may be disposed on the refrigerating compartment door 20*b* by a display device 90 described below. Light irradiated from the display device 90 may pass through the transmission portion 612 and be expressed in the form of surface light, and the transmission portion 612 may be output in the form of a bar. The see-through portion 611 may be referred to as a main display portion, and the transmission portion 612 may be referred to as an auxiliary display portion.

Also, although an example in which the see-through portion 611 and the transmission portion 612 are provided in the refrigerating compartment door 20*b* is described in this embodiment, the see-through portion 611 and the transmission portion 612 may be provided in various different types of refrigerator doors.

Figure 2:
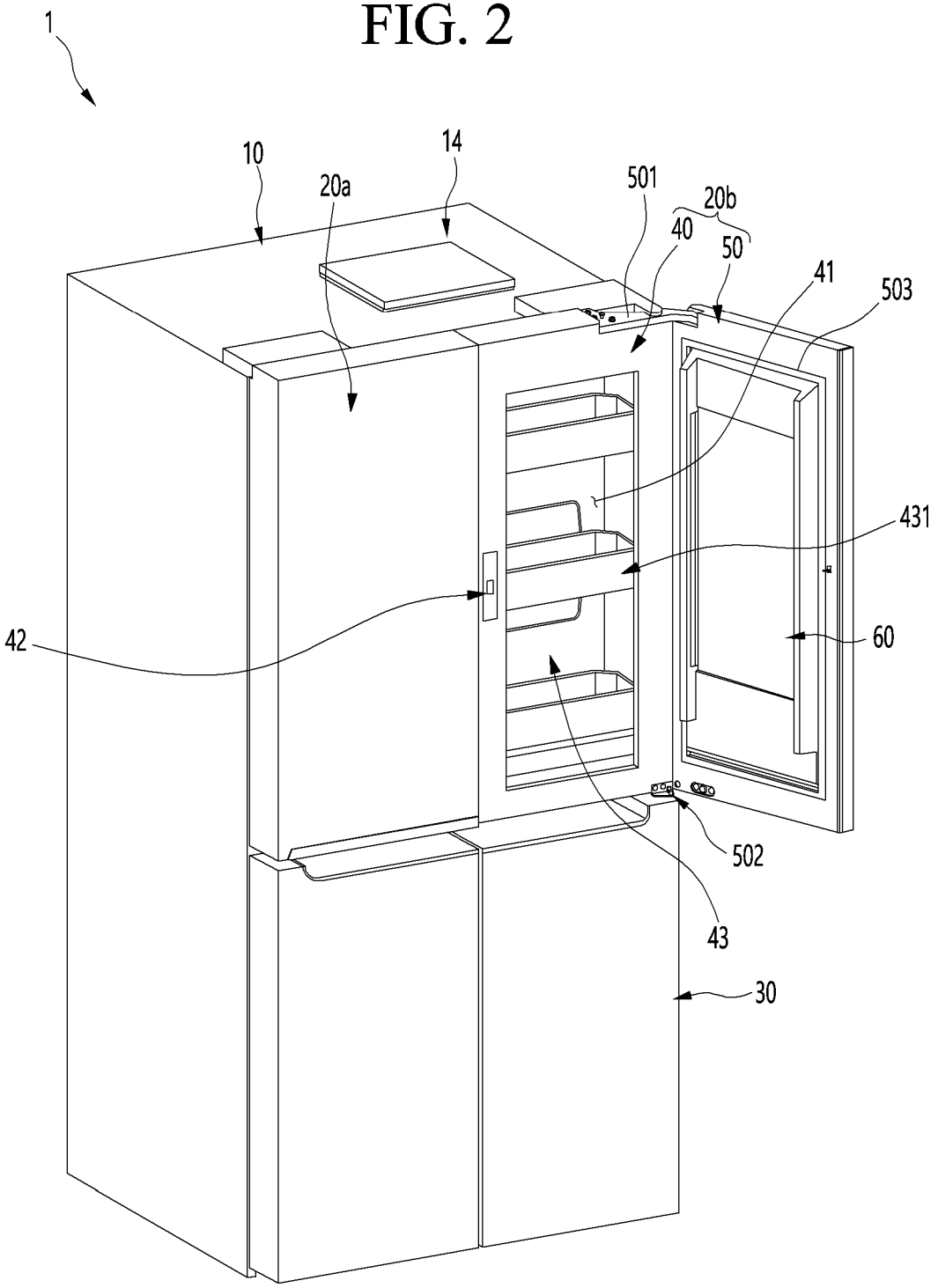
FIG. 2 is a perspective view illustrating a state in which a sub door of a door of the refrigerator is opened.

FIG. 2 is a perspective view illustrating a state in which a sub door of the door of the refrigerator is opened. In addition, FIG. 3 is a perspective view illustrating a state in which a main door of the door of the refrigerator is opened.

As illustrated in drawings, the right refrigerating compartment door 20*b* of the pair of refrigerating compartment doors 20 may be configured to be doubly opened and closed. In detail, the refrigerating compartment door 20*b*, which is disposed at the right side, may include a main door 40 that opening and closing the refrigerating compartment 12 and a sub-door 50 rotatably disposed on a main door 40 to open and close an opening defined in the main door 40.

The main door 40 may have the same size as that of the left refrigerating compartment door 20*a* of the pair of refrigerating compartment doors 20*a* and 20*b*. The main door 40 may be rotatably mounted on the cabinet 10 by an upper hinge 401 and a lower hinge 402 to open at least a portion of the refrigerating compartment 12.

Also, an opening 41 that is opened with a predetermined size is defined in the main door 40. A door basket 431 may be mounted on the rear surface of the main door 40 as well as the inside of the opening 41. Here, the opening 41 may have a size that occupies most of the front surface of the main door 40 except for a portion of a circumference of the main door 40.

A storage case 43 may be provided on the rear surface of the main door 40. A plurality of door baskets may be disposed in the storage case 43. When the sub-door 50 is opened, the storage case 43 may have a structure that is accessible through the opening 41. Also, the storage case 43 may be provided with a case door to access the inside of the storage case from the rear surface of the main door 40.

Also, a main gasket 45 may be disposed on a circumference of the rear surface of the main door 40 to prevent cool air within an internal space of the cabinet 10 from leaking when the main door 40 is opened.

The sub-door 50 may be rotatably mounted on the front surface of the main door 40 to open and close the opening 41. That is, a sub upper hinge 501 and a sub lower hinge 502 may be respectively provided on upper and lower ends of the sub-door 50 so that the sub-door 50 is rotatably mounted on the front surface of the main door 40. Thus, the sub-door 50 may be opened to expose the opening 41.

The sub-door 50 may have the same size as the main door 40 to cover the entire front surface of the main door 40. Also, when the sub-door 50 is closed, the main door 40 and the sub-door 50 may be coupled to each other to provide the same size and configuration as those of the left refrigerating compartment door 20*a*. Also, a sub gasket 58 may be disposed on the rear surface of the sub-door 50 to seal a gap between the main door 40 and the sub-door 50.

A panel assembly 60 through which the inside of the refrigerator is selectively visible and on which a screen is capable of being output is provided at a center of the sub-door 50. Therefore, even when the sub door 50 is closed, the inside of the opening 41 may be selectively seen through the see-through portion 611, and an image may be output on an area of the see-through portion 611.

The panel assembly 60 may be configured to be selectively transparent or opaque according to user's manipulation. Thus, only when desired by the user, the see-through portion 611 may be transparent so that the inside of the refrigerator 1 is visible, otherwise, the see-through portion 611 is maintained in an opaque state. In addition, when the panel assembly 60 is in the transparent or opaque state, a screen may be output through the see-through portion 611 by an operation of a display 63 described below.

In the embodiment, the panel assembly 60 is configured to shield an opened portion of the sub-door 50. However, according to types of the door, even when one door is configured as in the right door 20*b* of the refrigerating chamber 12, an opening may be formed in the door 20, and the transparent panel assembly may be mounted to shield the opening of the door 20. That is, it is noted that the panel assembly 60 may be applied to all types of doors, through which an opening is formed, regardless of the shape of the refrigerator and the shape of the door.

Therefore, for convenience of description and understanding, hereinafter, the sub door 50 will be referred to as a door 50.

Hereinafter, a structure of the door 50 will be described in more detail with reference to the accompanying drawings.

Figure 4:
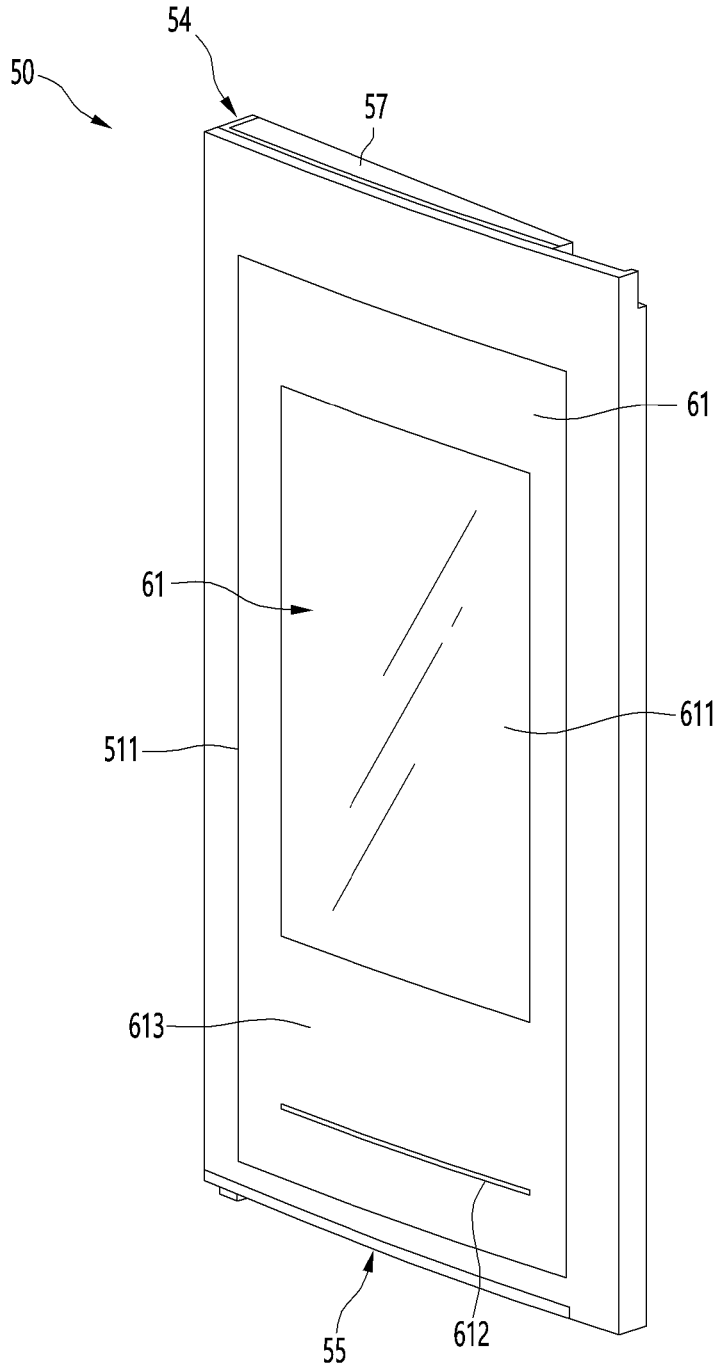
FIG. 4 is a perspective view of the door when viewed from the front.
Figure 5:
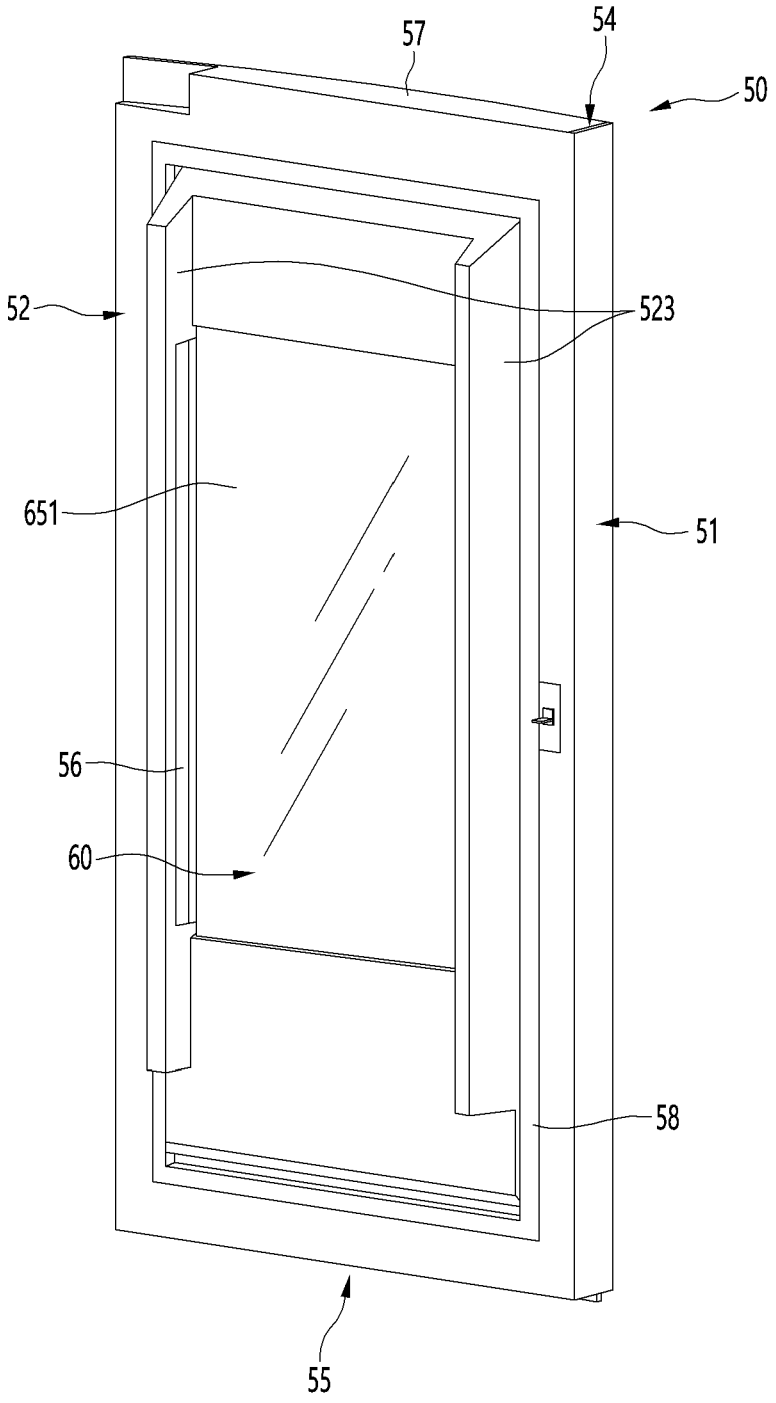
FIG. 5 is a perspective view of the door when viewed from the rear.
Figure 6:
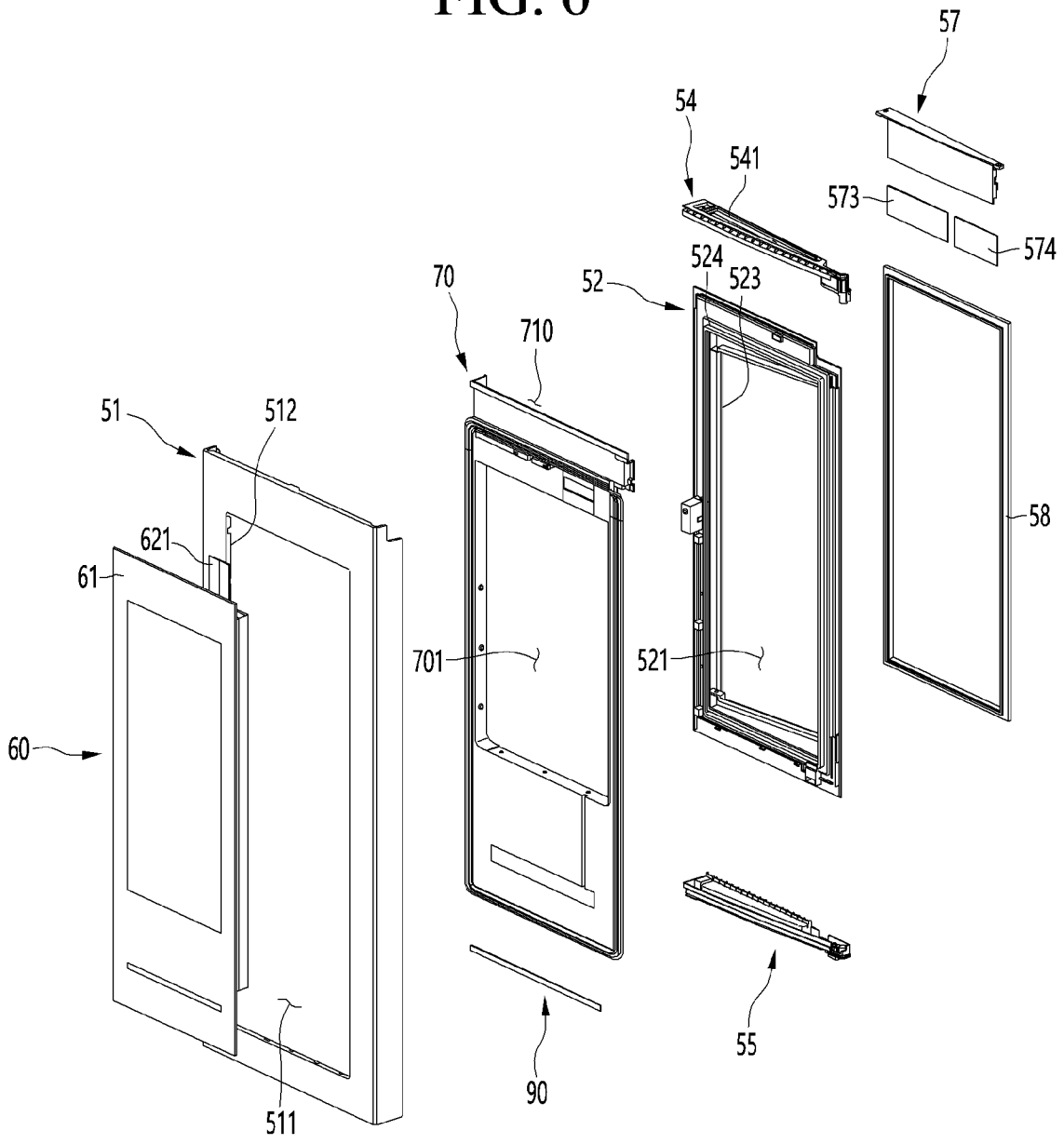
FIG. 6 is an exploded perspective view of the door.

FIG. 4 is a perspective view of the door when viewed from the front. Also, FIG. 5 is a perspective view of the door when viewed from the rear. Also, FIG. 6 is an exploded perspective view of the door.

As illustrated in the drawings, the door 50 may include an outer plate 51 defining an outer appearance of the door 50, a door liner 52 mounted to be spaced apart from the outer plate 51, the panel assembly 60 mounted on an opening of the outer plate 51 and the door liner 52, and upper and lower cap decorations 54 and 55 defining the top and bottom surfaces of the door 50. The above-described constituents may be coupled to define the whole outer appearance of the door 50.

The outer plate 51 may constitute an outer appearance of the front surface of the door 50 and a portion of a peripheral surface of the door 50 and be made of a stainless steel material. The outer plate 51 may constitute a portion of the outer appearance of the door 50 as well as the front surface of the door 50.

Also, a plate opening 511 may be defined at a center of the outer plate 51. Here, the plate opening 511 may be shielded by the panel assembly 60. Also, since the inside of the refrigerator 1 is visible through the panel assembly 60 that shields the plate opening 511, an internal region of the plate opening 511 may be referred to as the see-through portion 611.

A bent plate portion 512 that is bent backward may be disposed on a peripheral surface of the plate opening 511. The bent plate portion 512 may be disposed along a circumference of the plate opening 511 and be inserted into and fixed to a plate accommodation groove 703 defined in a front surface of a supporter frame 70 to be described below.

Both surfaces of the outer plate 51 may be bent to define an outer appearance of a side surface of the door 50. Both ends of the outer plate 51 may be coupled to the door liner 52. Also, upper and lower ends of the outer plate 51 may be coupled to the upper cap decoration 54 and the lower cap decoration 55, respectively. An insulating material 53 may be filled inside the door 40 except for the panel assembly 60, i.e., inside the outer plate 51, the door liner 52, the upper cap decoration 54, and the lower cap decoration 55.

The door liner 52 defines the rear surface of the door 50 and has a door liner opening 521 in the area on which the panel assembly 60 is disposed. Also, a sub gasket 58 for sealing a gap between the door 50 and the main door 40 may be mounted on the rear surface of the door liner 52.

Also, a door light 56 may be provided on each of both sides of the door liner opening 521. The door light 56 may illuminate the rear surface of the door 50 and a rear side of the panel assembly 60. The door light 56 may be mounted on a light mounting portion 523 protruding backward from a rear surface of the door 50.

Thus, when the door light 56 is turned on, the inside of the storage case 43 may be brightened, and thus, the inside of the refrigerator may be more brightened up than the outside of the refrigerator so that a rear space of the door 50 may be visible through the panel assembly 60.

Also, if the door light 56 is turned on when the panel assembly 60 outputs the screen, the panel assembly 60 may function as an auxiliary backlight to allow the screen to be more clear.

The upper cap decoration 54 may define a top surface of the door 50 and be coupled to upper ends of the outer plate 51 and the door liner 52. The top surface of the upper cap decoration 54 is opened so that a decoration opening 541 communicating with an upper space of the panel assembly 60 is formed, and is shielded by a decoration cover 57.

PCBs 573 and 574 for operating electrical components inside the panel assembly 60 and the door may be mounted on the decoration cover 57 inserted into the upper cap decoration 54. The PCBs 573 and 574 may be configured in at least one module form and may be provided in the PCB accommodating space 710 above the door 50.

Here, an inner space of the door 50 except for the PCB accommodating space 710 communicating with the decoration opening 541 may be filled with an insulating material 53.

The lower cap decoration 55 may define a bottom surface of the door 50 and be coupled to lower ends of the outer plate 51 and the door liner 52.

The panel assembly 60 may be disposed between the outer plate 51 and the door liner 52. Also, a front surface of the panel assembly 60 may shield the plate opening 511, and a rear surface of the panel assembly 60 may shield the door liner opening 521. Also, the panel assembly 60 may be selectively manipulated to one state of transparent, translucent, opaque, and screen output states by the user.

Thus, the panel assembly 60 may define a portion of an outer appearance of each of the front surface and the rear surface of the door 50. In addition, the user may selectively see through the inner space of the door 50 through the panel assembly 60 and also see the screen output through the panel assembly 60.

The supporter frame 70 configured to support the panel assembly 60 is mounted on a rear surface of the outer plate 51. The panel assembly 60 may be maintained in the fixed and mounted state by the supporter frame 70. Particularly, a front surface of the outer plate 51 and a front surface of the panel assembly 60 may be disposed on the same extension line so that a front surface of the door 50 has a sense of unity.

A frame opening 701 is defined at a center of the supporter frame 70. The frame opening 701 has a size somewhat less than that of the plate opening 511 and has a structure in which the panel assembly 60 is seated thereon. In the state in which the panel assembly 60 is mounted on the supporter frame 70, the front surface of the panel assembly 60 may shield the plate opening 511 and be exposed forward. A rear surface of the panel assembly 60 may shield the liner opening 521 and be exposed backward.

The panel assembly 60 may have a size that is enough to cover the plate opening 511 and the liner opening 521 inside the door 50. Also, the see-through portion 611 may be provided in the transparent panel assembly 60 so that the inner space of the refrigerator is selectively visible, and a screen is outputted.

Also, the front surface of the panel assembly 60, which is exposed forward through the outer plate 51, may include the see-through portion 611 through which the inside of the panel assembly 60 is visible and on which a scree is output, a bezel 613 provided to be opaque along a circumference of the see-through portion 611, and a transmission portion 612 through which light is transmitted from a lower side of the see-through portion 611.

In detail, the bezel 613 may be disposed on a circumference of a front panel 61 defining the front surface of the panel assembly 60. The bezel 613 may be printed with an opaque color such as black, and components disposed behind the front panel 61 may be covered so as not to be exposed to the outside.

Also, a central area on which the bezel 613 is not disposed may be the see-through portion 611, and the see-through portion 611 may have a size corresponding to a position corresponding to the display 63. Thus, the see-through portion 611 defines an area through which the inside of the refrigerator is visible and defines an area on which the screen is output when the display 63 operates. Thus, the see-through portion 611 may be referred to as an output portion, a visualization portion, and a main display portion.

Also, the transmission portion 612, which is narrowed in a vertical direction and extends lengthily in a horizontal direction, may be disposed below the see-through portion 611. The transmission portion 612 may also be provided to allow light to be transmitted because the bezel 613 is not provided. Thus, information may be displayed, or an operation state of the refrigerator 1 may be displayed by the transmitted light.

For example, the see-through portion 611 may display a voice recognition state, a touch or note operation input state, an internal temperature, a time setting state, and the like and may be displayed as a surface emission area such as a bar graph. In addition, while the surface emission area moves or is changed in length, the see-through portion 611 may be dynamically displayed. Since the transmission portion 612 is displayed in the form of a line, the transmission portion 612 may be referred to an auxiliary display portion.

Also, the transmission portion 612 may be disposed on an area between a lower end of the see-through portion 611 and a lower end of the front panel 61. Also, the transmission portion 612 may have a vertical width of approximately 2 mm to approximately 5 mm and may have a length corresponding to a horizontal length of the see-through portion 611.

The display device 90 that irradiates light toward the transmission portion 612 may be provided at a rear side corresponding to the transmission portion 612. Also, the display device 90 may be accommodated inside the display mounting portion 74 disposed below the supporter frame 70.

Hereinafter, the structure of the panel assembly 60 will be described in more detail with reference to the drawings.

Figure 7:
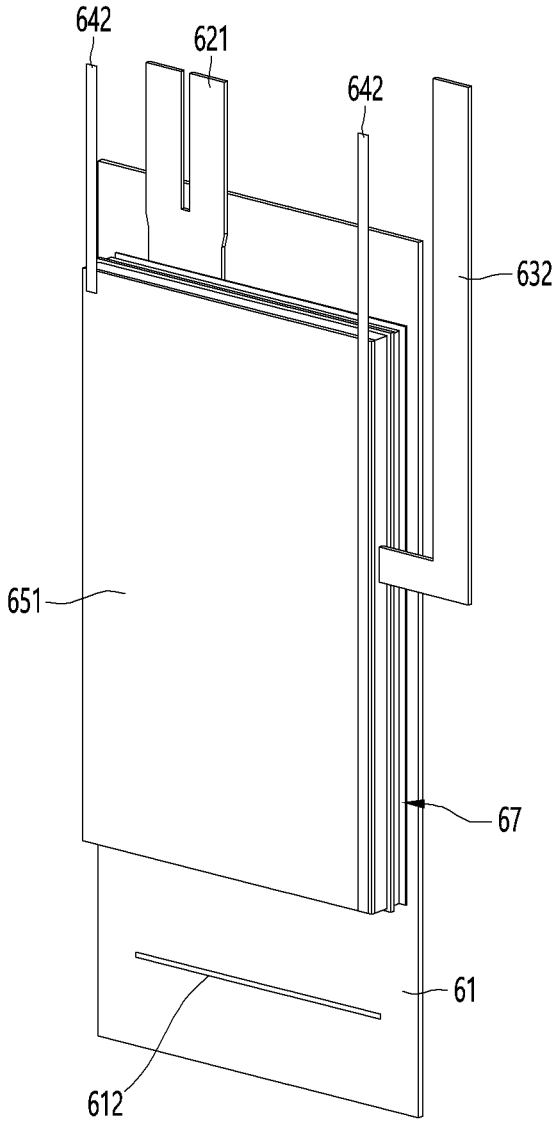
FIG. 7 is a perspective view of a panel assembly that is one component of the door when viewed from the rear.
Figure 8:
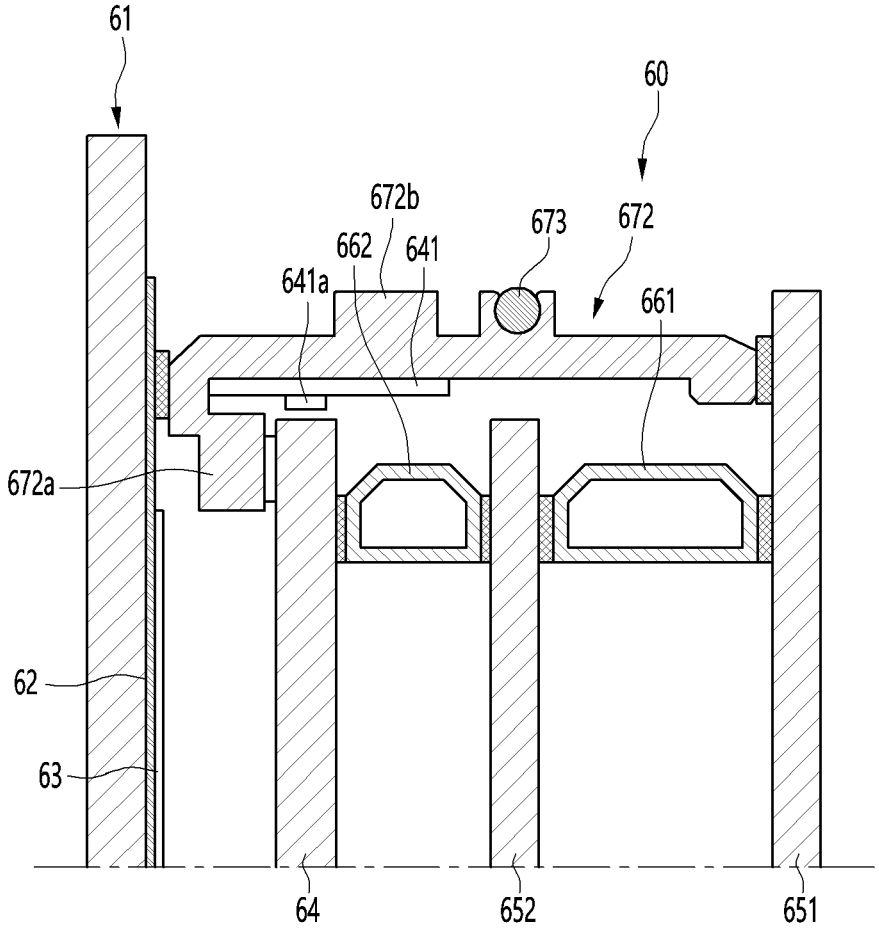
FIG. 8 is a cross-sectional view illustrating an upper end of the panel assembly.

FIG. 7 is a rear perspective view of the panel assembly that is one component of the door. In addition, FIG. 8 is a cross-sectional view illustrating an upper end of the panel assembly.

As illustrated in the drawings, the panel assembly 60 may be constituted by a plurality of plate-shaped panels, and each of the panels may be spaced a predetermined interval from each other by at least one spacer to constitute one assembly.

In detail, the panel assembly 60 may have an outer appearance that is defined by the front panel 61 and the rear panel 651, which define the front and rear surfaces of the transparent panel assembly 60, and an outer frame 67 connecting the front panel 61 to the rear panel 651.

The front panel 61 may be made of a transparent material that defines an outer appearance of the front surface of the panel assembly 60. The front panel 61 may have a size corresponding to that of the plate opening 511 and may have a size greater than that of the frame opening 701. Thus, the rear surface of the front panel 61 may be supported by the supporter frame 70. Also, in a state in which the panel assembly 60 is mounted, an end of the front panel 61 may be in contact with an end of the plate opening 511, and the plate opening 511 and a circumference of the front panel 61 may be in contact with each other.

In detail, the circumference of the front panel 61 may further protrude outward than the rear panel 651. Thus, the circumference of the front panel 61 defining the front surface of the panel assembly 60 may further extend to the outside of the frame opening 701 and thus may be stably supported by the supporter frame 70. The rear panel 651 as well as the outer frame 67 may be inserted into the frame opening 701.

Also, the supporter frame 70 may be coupled to the panel assembly 60 by coupling the outer frame 67 to a coupling member such as a screw. Thus, a circumference of the panel assembly 60 may be supported by the supporter frame 70 and be maintained in a state of being fixed to the door 50.

A touch screen bonding (TSB) 62 may be disposed on the rear surface of the front panel 61. The touch screen 62 may have a transparent film shape and be attached to the rear surface of the front panel 61 to sense user's touch manipulation. The touch screen 62 may be referred to as a touch sensing device or a touch sensor.

A touch cable 621 connected to the touch sensor 62 may be disposed on an outer end of the front panel 61. The touch cable 621 may connect the touch screen 62 to the PCB 573 above the door 50.

In addition, each of the display cable 632 connected to the display 63 and the light cable 642 connected to the display light 641 may also be provided in the form of a flat cable, and all of the cables 621, 632, and 642 may extend up to the upper end of the panel assembly 60 and be connected to the PCBs 573 and 574.

The display 63 may be disposed on the rear surface of the front panel 61. The display 63 may be configured to output a picture or an image through the see-through portion 611 and may have a size corresponding to that of the see-through portion 611. The display 63 may be provided in the form of a module on which a screen is capable of being output. Also, the display 63 may be transparent so that the user sees the inside through the display 63 when the screen is not outputted. Thus, the display 63 may be referred to as a transparent display and may have various shapes.

In addition, a source board 631 may be disposed on one end of both left and right sides of the display 63. The source board 631 may be disposed inside the outer frame 67 so as not to be exposed through the see-through portion 611.

The source board 631 may be connected to the display cable 632. The display cable 632 may extend along the circumferential surface of the panel assembly 60 and may be coupled with the PCB 573.

A first spacer 643 may be provided on each of both left and right sides of the display 63. The first spacer 643 may allow the display 63 and the light guide plate 64 to be maintained at a set distance. Also, the first spacer 643 may have a rod shape extending from an upper end to a lower end of the display 63 and may be made of aluminum.

The outer frame 67 may have a rectangular frame shape. The outer frame 67 may connect the rear surface of the front panel 61 to the front surface of the rear panel 651 and also define the peripheral surface of the panel assembly 60.

In detail, the outer frame 67 may define a circumference of an outer portion of the panel assembly 60 and also have a connection structure that is capable of allowing the front panel 61 to be maintained at a certain distance. The outer frame 67 may be disposed along the circumference of the panel assembly 60.

That is, the overall outer appearance of the panel assembly 60 may be defined by the front panel 61, the rear panel 651, and the outer frame 67, and all of the remaining constituents may be provided in the outer frame 67.

In detail, the light guide plate 64 is configured so that light irradiated from the display light 641 is diffused or scattered to illuminate the display 63 at the rear side. For this, the light guide plate 64 may have a plate shape. The display light 641 may be disposed at a position corresponding to each of upper and lower ends of the light guide plate 64.

The light guide plate 64 may be disposed behind the display 63 and may be supported by a first spacer (not shown) disposed on each of both left and right sides of the rear surface of the front panel 61 and a light guide plate support portion 672*a* disposed on the outer frame 67. Thus, the light guide plate 64 may be spaced a predetermined distance from the display 63.

A pair of second spacers 661, 661 may be disposed between the rear panel 651 and the light guide plate 64. An insulating panel 652 may be supported by the second spacers 661 and 662, and the insulating panel 652 may maintain a state of being spaced apart from the light guide plate 64 and the rear panel 651.

The insulating panel 652 may be maintained to be spaced a set interval from each of the insulating panel 652 and the rear panel 651 by the pair of second spacers 661 and 662. A double-layered insulating space may be defined by the pair of second spacers 661 and 662, the insulating panel 652, and the rear panel 651. In addition, an insulating space may be defined to be vacuumed or be defined by injecting an insulating gas.

The display light 641 may be mounted at positions corresponding to a top surface and a bottom surface of the circumference of the panel assembly 60 on an inner surfaces of the outer frame 67. The LED 641*a* of the display light 641 may emit light toward an end of the light guide plate 64. Thus, the light emitted through the LED 641 may travel along the light guide plate 64 so that an entire surface of the light guide plate 64 emits light.

A heater 673 may be disposed along an outer surface of the outer frame 67. The heater 673 may be provided in the form of a wire and be mounted on the outer surface of the outer frame 67. Heat generated by the heater 673 may heat the circumference of the front panel 61 along the outer frame 67 to prevent condensation from occurring.

Also, a panel assembly fixing portion 672*b* may be disposed on the outer surface of the outer frame 67. A screw passing through the supporter frame 70 may be coupled to the panel assembly fixing portion 672*b*. The panel assembly 60 may be maintained in a state of being mounted on the supporter frame 70 by the coupling of the screw.

Hereinafter, the structure of the frame 70 will be described in more detail with reference to the drawings.

Figure 9:
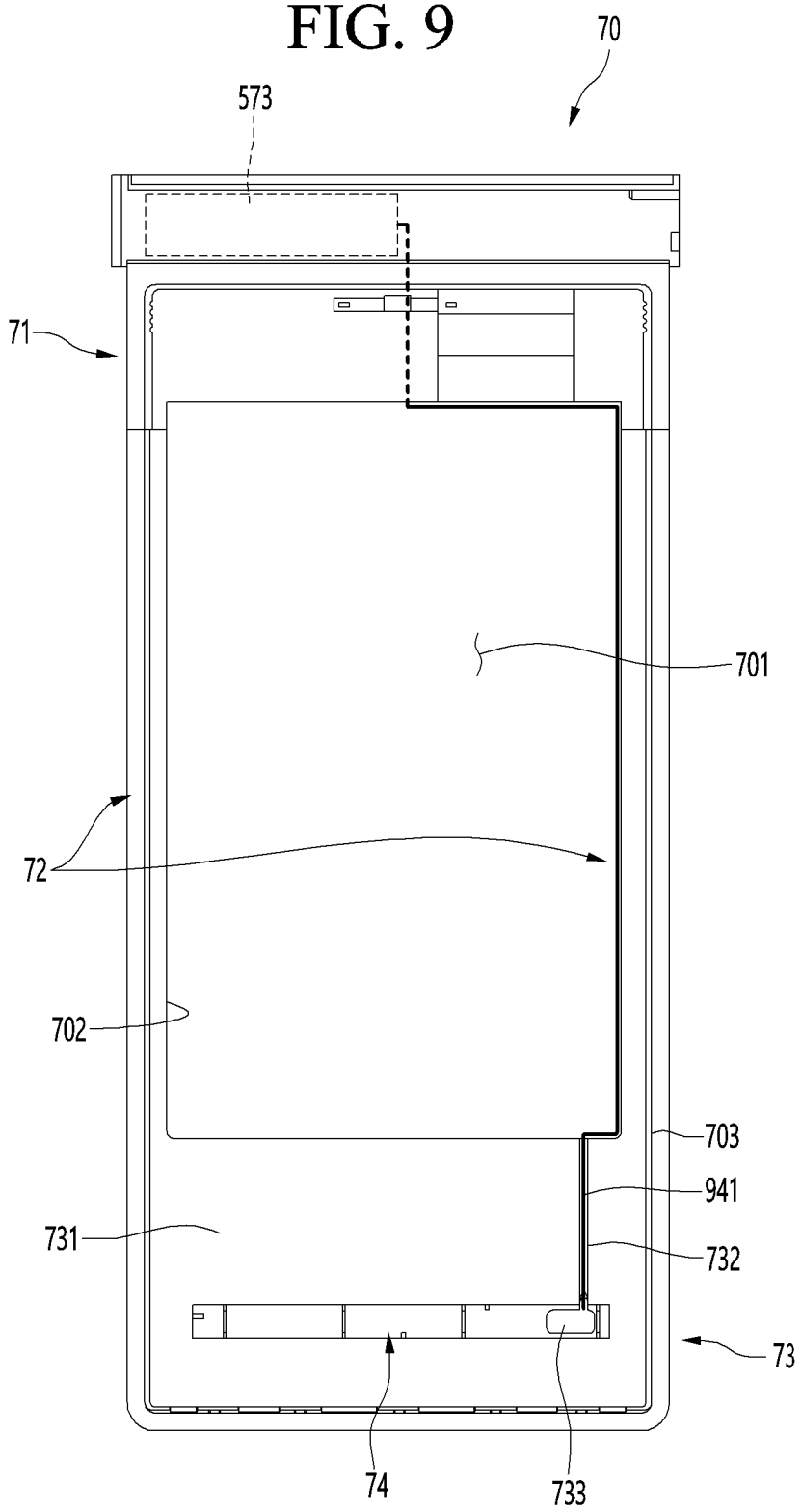
FIG. 9 is a front view of a supporter frame that is one component of the door.

FIG. 9 is a front view of the supporter frame that is one component of the door.

As illustrated in the drawings, the supporter frame 70 may be injection-molded using a plastic material and may have a rectangular frame shape so that a frame opening 701 is defined at a center thereof. Also, the supporter frame 70 may have a predetermined width and be coupled to the outer plate 51, and simultaneously, the panel assembly 60 may be fixedly mounted on the supporter frame 70.

The supporter frame 70 may include an upper frame 71 defining an upper portion, a lower frame 73 defining a lower portion, and a side frame 72 connecting both ends of each of the upper frame 71 and the lower frame 73 to each other.

In detail, the supporter frame 70 may define the overall shape of the supporter frame 70 having the rectangular frame shape by coupling the upper frame 71, the lower frame 73, and the pair of side frames 72 to each other.

The upper frame 71 may support an upper portion of the outer plate 51 and an upper portion of the front panel 61. The upper frame 71 may define a shape of the upper portion of the supporter frame 70 and may divide the upper space of the door 50 in a front and rear direction. That is, the upper frame 71 may be provided with an upper extension part 711 extending up to the top surface of the door 50, and the space above the door 50 may be divided forward and backward by the upper extension part 711.

Thus, the upper side of the door 50 may be divided forward and backward by the upper frame 71, and a PCB accommodating space 710 in which the PCB 573 is accommodated may be defined in a rear space.

The lower frame 73 may be coupled to a lower end of the side frame 72 and may be configured to support a lower portion of the outer plate 51 and a lower portion of the panel assembly 60.

The side frame 72 may define both left and right sides of the supporter frame 70 and extend lengthily in a vertical direction to connect the upper frame 71 to the lower frame 73. That is, the side frame 72 has a structure that is capable of being coupled to both ends of the upper frame 71 and the lower frame 73.

The overall structure of the supporter frame 70 may have the rectangular frame shape by coupling the upper frame 71, the lower frame 73, and the side frame 72 to each other. In a state in which the supporter frame 70 is assembled, a panel assembly support portion 702 extending backward may be disposed on a circumferential surface of the frame opening 701 defined at the center of the supporter frame 70.

The panel assembly support portion 702 may extends backward to have a predetermined width and may be disposed to be in contact with the circumferential surface of the panel assembly 60, that is, the outer frame 67. Also, the screw that is coupled to pass through the panel assembly support portion 702 may be coupled to the outer frame 67 so that the panel assembly 60 is stably fixed and mounted on the supporter frame 70.

Also, a plate accommodation groove 703 recessed along a circumference of the supporter frame 70 may be disposed on a front surface of the supporter frame 70. The plate accommodation groove 703 may be recessed at a position corresponding to the bent plate portion 512 so that the bent plate portion 512 of the outer plate 51 is inserted and may be disposed along the bent plate portion 512. In addition, the bent plate portion 512 may be disposed to be in contact with the circumference of the front panel 61 in the state of being inserted into the plate accommodation groove 703.

Inner and outer surfaces of the plate accommodation groove 703 may define a plane having the same height, and thus, the front circumference of the supporter frame 70 may stably support the rear surface of the outer plate 51 corresponding to the circumferential surface of the plate opening 511. That is, each of the upper frame 71, the lower frame 73, and the pair of side frames 72 may support the outer plate 51.

In this embodiment, the supporter frame 70 may have a structure in which the supporter frame 70 is molded to be separated into four parts, but the supporter frame 70 may be provided by coupling two or more components to each other, as necessary.

The display mounting portion 74, on which the display device 90 is mounted, in addition to the structure of supporting and fixing each of the outer plate 51 and the lower portion of the panel assembly 60 may be disposed on the lower frame 73.

The display device 90 may be accommodated inside the display mounting portion 74. In addition, in the state in which the display device 90 is mounted inside the display mounting portion 74, a wire connected to the display device 90 may be guided to an inner surface of the frame opening 701 by passing through a connector groove 733 and a wire guide portion 732, which are provided in the lower frame 73 and then be connected to extend up to the PCB 573 mounted on the upper frame 71 along the inner surface of the frame opening 701.

Hereinafter, a structure in which the auxiliary display 340 is mounted will now be described in more detail with reference to the accompanying drawings.

Figure 10:
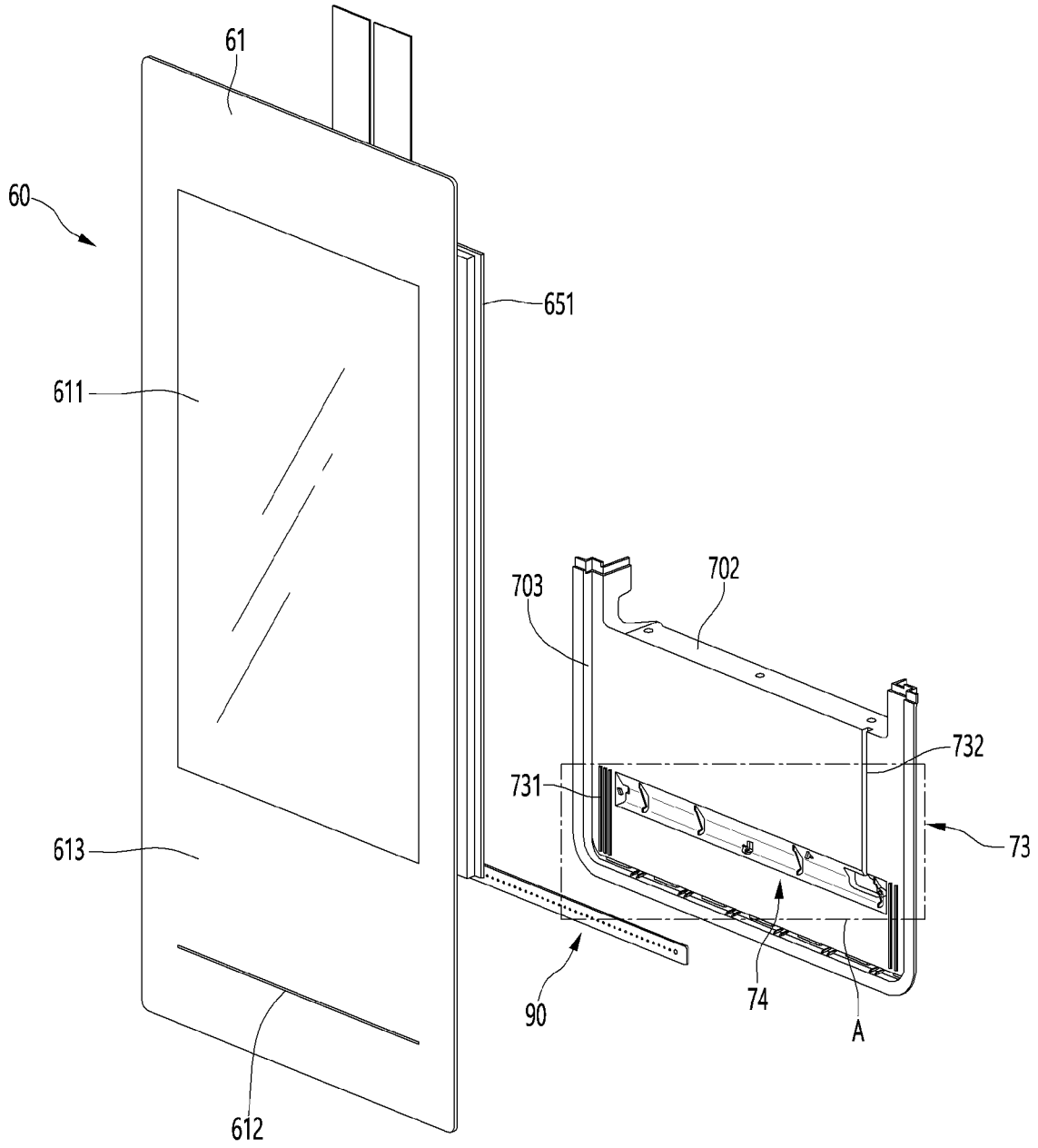
FIG. 10 is an exploded perspective view illustrating a coupling structure of the panel assembly, an auxiliary display, and a lower frame.
Figure 11:
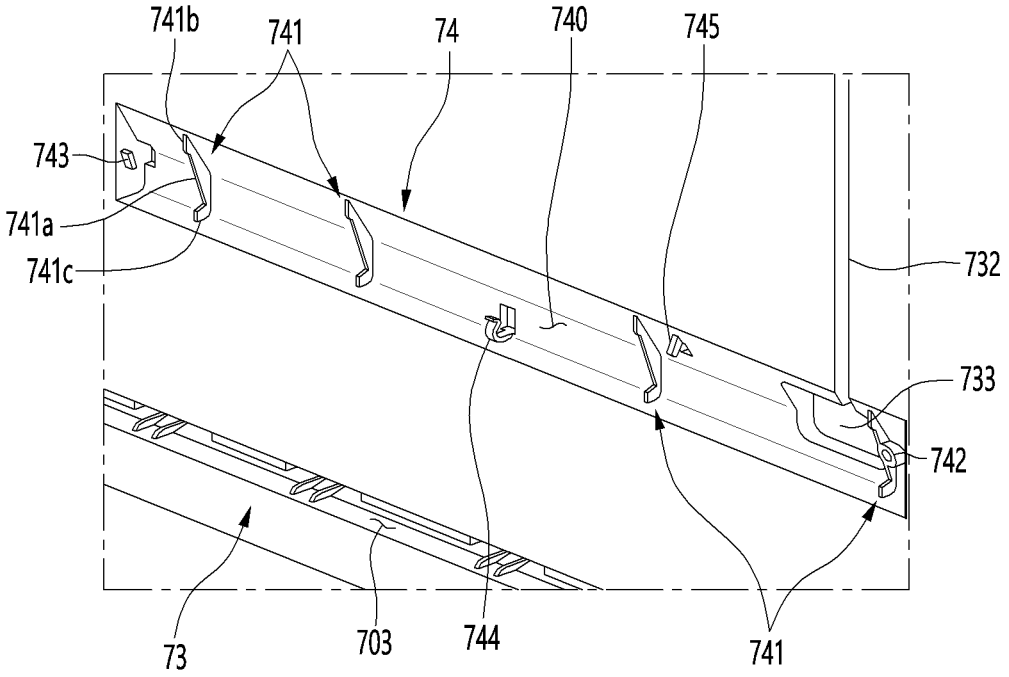
FIG. 11 is an enlarged view illustrating a portion A of FIG. 10.

FIG. 10 is an exploded perspective view illustrating a coupling structure of the panel assembly, the auxiliary display, and the lower frame. In addition, FIG. 11 is an enlarged view illustrating a portion A of FIG. 10. In addition, FIG. 12 is a front view illustrating the auxiliary assembly of FIG. 13.

As illustrated in the drawings, the lower frame 73 may define a lower portion of the supporter frame 70 and may support a bottom surface of the circumferential surface of the panel assembly 60. In addition, the lower frame 73 may be mounted to be in contact with a rear surface of the front panel 61. Here, most of a front surface 731 of the lower frame 73 may be in surface contact with the rear surface of the front panel 61. Here, the rear surface of the front panel 61 and the front surface 731 of the lower frame 73 may be bonded to each other with an adhesive. Also, the lower frame 73 may be disposed at a position corresponding to the lower portion of the front panel 61 to shield the transmission portion 612 at a rear side.

The transmission portion 612 may be disposed on an area of a bezel 613 under the front panel 61. The transmission portion 612 may be disposed at a position corresponding to the display mounting portion 74 and may be disposed in front of the display device 90. The transmission portion 612 may be provided by cutting a portion of the bezel 613 to define a slit-shaped area through which light is transmitted. Thus, the light irradiated from the display device 90 may pass through the transmission portion 612 and be displayed to the outside. Here, the transmission portion may shine in the form of surface light according to the position of the display device 90.

Figure 12:
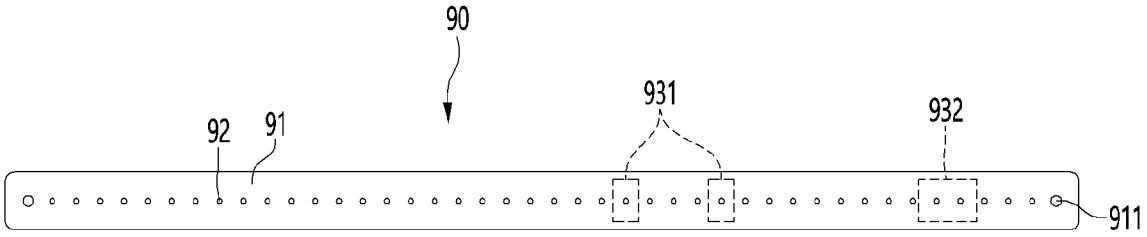
FIG. 12 is a front view of the auxiliary display.

As illustrated in FIG. 12, the display device 90 may include a substrate 91 and a plurality of LEDs 92 mounted on the substrate 91. In addition, the plurality of the LEDs 92 may be continuously arranged at regular intervals along the substrate 91. Thus, the display device 90 may be referred to as a line display LED bar.

The substrate 91 may have a size that is capable of being accommodated in the display mounting portion 74 and may extend in a left and right direction. The substrate 91 as a whole may be provided to be larger than a transverse length of the transmission portion 612. In addition, the LED 92 disposed at each of both ends among the LEDs 92 may be disposed at the same position as each of both ends of the transmission portion 612 or disposed inside the transmission portion 612, and thus, when all the LEDs 92 is turned on, the entire surface of the transmission portion 612 may shine in the form of the surface light.

The LEDs 92 may be continuously disposed on a front surface of the substrate 91, and elements 931 for controlling the LED 92 may be mounted on a rear surface of the substrate 91. Also, a substrate connector 932 to which the wire 941 for supplying power to the substrate 91 is connected may be provided at one side of the rear surface of the substrate 91. The substrate connector 932 may be disposed at a position corresponding to the connector groove 733 to facilitate the connection to the wire 941 based on a center of the substrate 91.

Also, a screw hole 911 through which a screw 95 coupled to fix the substrate 91 pass may be defined in one end of the substrate 91. When the screw 95 is coupled to pass through the screw hole 911, the display device 90 may be fixed and mounted inside the display mounting portion 74.

The display mounting portion 74 may be recessed to accommodate the display device 90 therein. In addition, the opened front surface of the display mounting portion 74 may be shielded by the front panel 61. The display device 90 may be accommodated inside the display mounting portion 74 and may not interfere with the front panel 61 when the front panel 61 and the lower frame 73 are coupled to each other.

The display mounting portion 74 may be recessed in the front surface of the lower frame 73. The display mounting portion 74 may have a size that is slightly greater than that of the substrate 91.

The display device 90 may be mounted inside the display mounting portion 74 and may be disposed to be inclined with respect to the front panel 61 so that the transmission portion 612 shines in the form of the surface light.

In addition, a support portion 741 supporting the display device 90 at the rear side may protrude inside the display mounting portion 74. The support portion 741 may be provided in the form of a rib, and a plurality of support portions 741 may be arranged at regular intervals inside the display mounting portion 74.

In addition, the support portion 741 may include a rear support portion 741*a* that supports a rear surface of the substrate 91, an upper support portion 741*b* that restricts an upper end of the substrate 91, and a lower support portion 741*c* that restricts a lower end of the substrate 91.

The rear support portion 741*a* may extend vertically and be in contact with the rear surface of the substrate 91 to support the substrate 91 at the rear side. Particularly, the rear support portion 741*a* may be disposed to be inclined so that the substrate 91 is inclined at a set angle with respect to the front panel 61.

In addition, the upper support portion 741*b* and the lower support portion 741*c* may protrude forward from the upper and lower ends of the rear support portion 741*a*, respectively, and may be in contact with the upper and lower ends of the substrate 91. Therefore, the substrate 91 may maintain the set inclination and the correct mounting position in the state of being mounted on the support portion 741. Particularly, when the substrate 91 is mounted, the LED 92 may not be disposed on the same extension line as the transmission portion 612, but may be disposed at a crossing position in the vertical direction to prevent the LED 92, which emits light through the transmission portion 612, from being directly exposed.

In addition, a coupling portion 742 may be disposed at one end of both left and right ends of the display mounting portion 74. For example, the coupling portion 742 may be disposed at the right side of the display mounting portion 74. The coupling portion 742 may protrude forward from a position corresponding to the coupling hole 911 defined to pass through one end of the substrate 91.

In the state in which the substrate 91 is mounted on the support portion, the right end of the rear surface of the substrate 91 may be in contact with the coupling portion 742. In addition, the right end of the substrate 91 may be restricted by coupling the screw 746 to sequentially pass through the coupling hole 911 and the coupling portion 742.

In addition, a side restriction portion 743 protruding inward may be disposed at one end opposite to the coupling portion 742 among both the left and right ends of the display mounting portion 74. For example, the side restriction portion 743 may protrude inward from the left surface of the display mounting portion 74. The side restriction portion 743 may be spaced apart from the rear surface of the display mounting portion 74 and may provide a space into which a side end of the substrate 91 is inserted. When the substrate 91 is mounted, the side restriction portion 743 may be restricted to be hooked with the left end of the front surface of the substrate 91.

The substrate 91 may be prevented from moving in the left and right direction by the coupling portion 742 and the side restriction portion 743 and then may be restricted in movement forward and backward.

Also, a lower restriction portion 744 may protrude upward from a bottom surface of the display mounting portion 74. The lower restriction portion 744 may be provided in the form of an elastic ring and protrude upward from a bottom surface to press and fix the lower end of the front surface of the substrate 91. In addition, the lower restriction portion 744 may have a structure which is opened upward so that the substrate 91 is capable of being inserted downward from an upper side.

An upper restriction portion 745 may protrude from an upper portion of the display mounting portion 74. The upper restriction portion 745 may protrude downward from the inner surface of the display mounting portion 74 and may be fixed by pressing the upper end of the substrate 91 when mounting the substrate 91 thereon.

Thus, the upper and lower restriction portions 744 and 745 may further prevent the substrate 91 from moving vertically and moving the forward and backward.

A connector groove 733 may be further recessed inside the display mounting portion 74. The connector groove 733 may be defined at a position corresponding to a connector 932 protruding from the rear surface of the substrate 91, and the connector 932 may be disposed in the connector groove 733.

In addition, the lower frame 73 may be provided with a wire guide portion 732 connecting the display mounting portion 733 to the frame opening 701. The lower wire guide portion 732 may guide the wire 941 connected to the connector 932 from the display mounting portion 74 to the inside of the frame opening 701.

The lower frame 73 may be covered without being exposed forward by the bezel 613, and thus, the display device 90 and the wire 941 may not be exposed to the outside. However, light irradiated from the display device 90 may be transmitted to the outside through the transmission portion 612.

Hereinafter, a state in which the display device 90 is mounted will be described in more detail with reference to the drawings.

Figure 13:
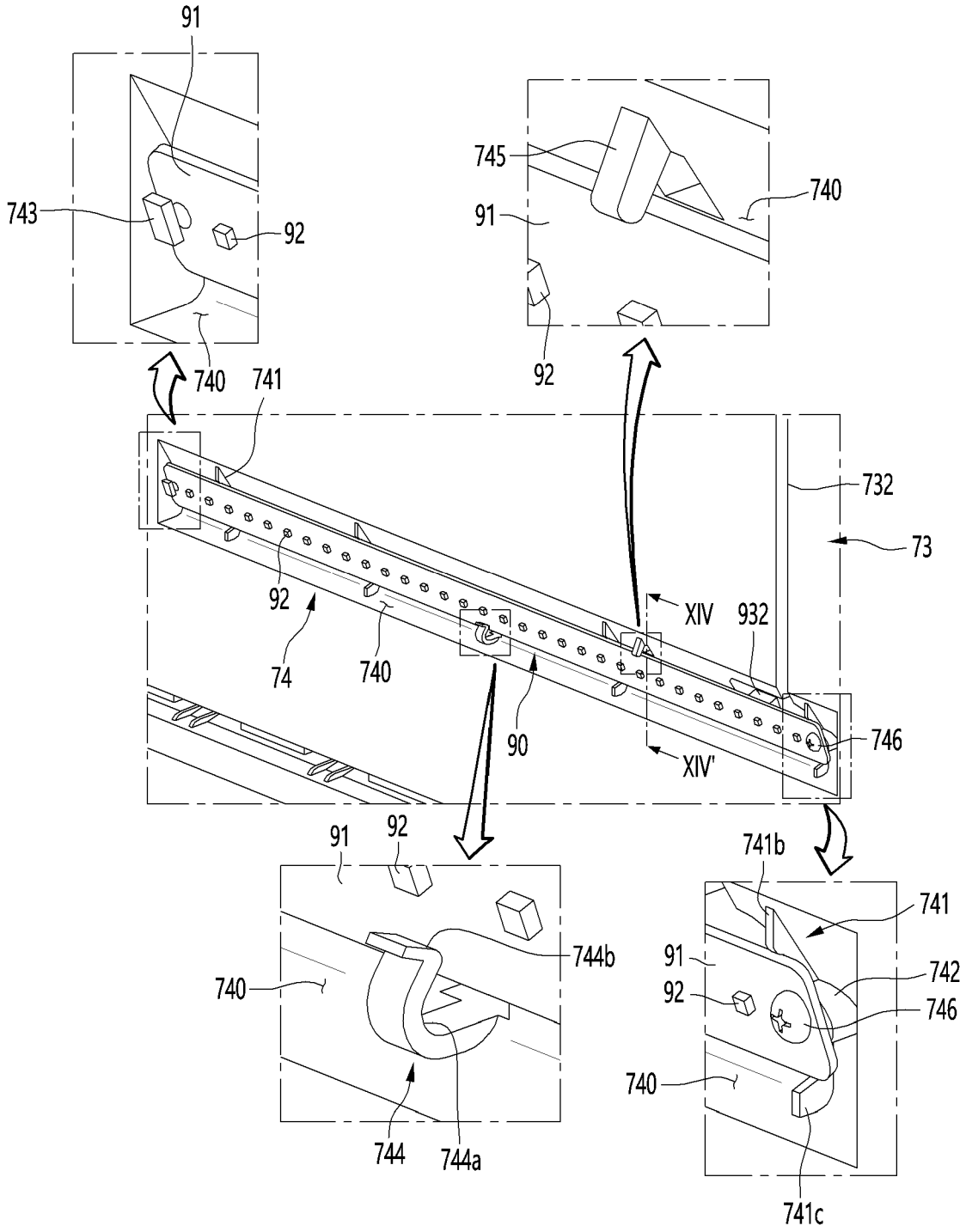
FIG. 13 is a view illustrating a state in which the auxiliary display is mounted.
Figure 14:
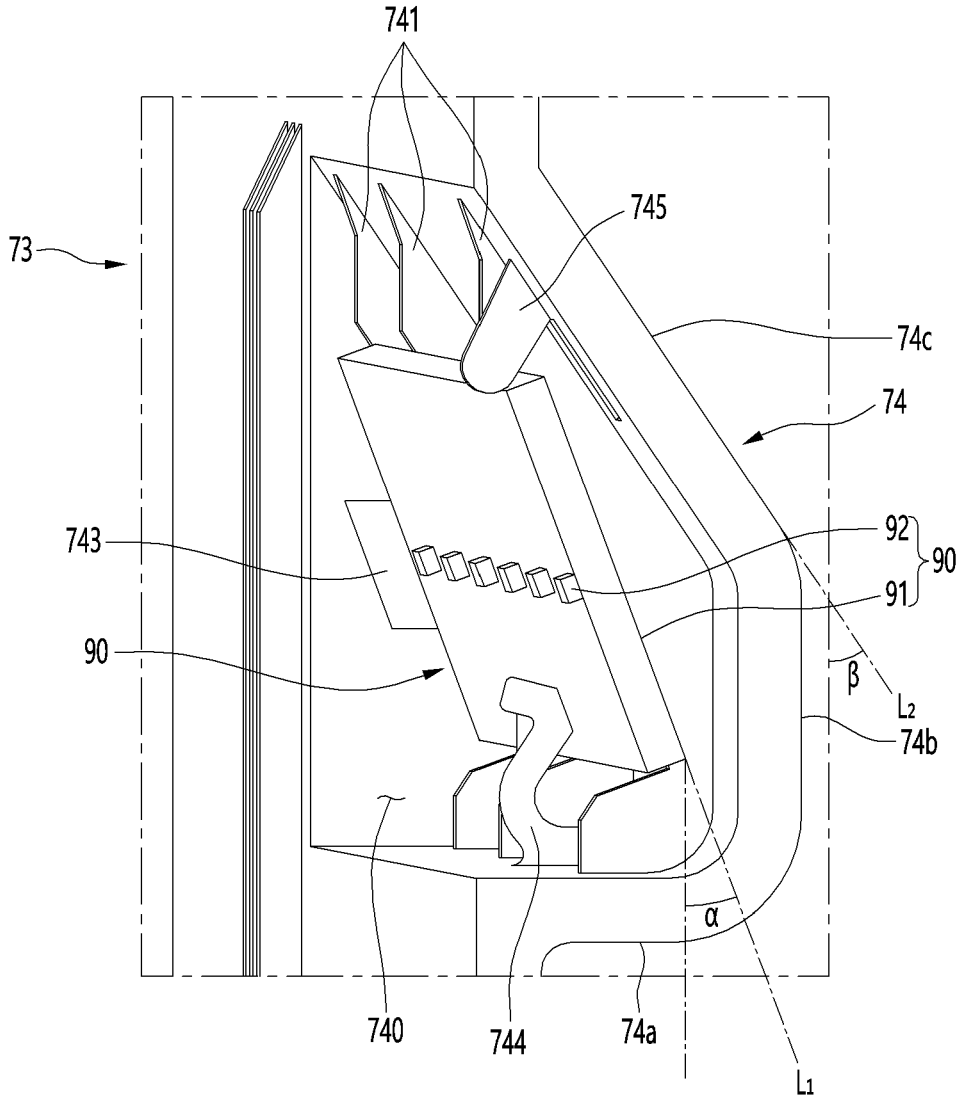
FIG. 14 is a cutaway perspective view taken along line XIV-XIV' of FIG. 13.

FIG. 13 is a view illustrating a state in which the auxiliary display is mounted. In addition, FIG. 14 is a cutaway perspective view taken along line XIV-XIV' of FIG. 13.

As illustrated in the drawings, in order to mount the display device 90 inside the display mounting portion 74, first, while moving the substrate 91 downward from the upper side of the lower restriction portion 744, the display device 90 may be inserted between the lower restriction portion 744 and the inner surface of the display mounting portion 74.

Here, the lower restriction portion 744 may include an elastic portion 744*a* and a pressing portion 744*b*. The elastic portion 744*a* may extend upward from the bottom surface of the display mounting portion 74 and be bent at a predetermined curvature to be elastically deformable. In addition, the pressing portion 744*b* protruding to be in contact with the front surface of the substrate 91 may be disposed on an end of the elastic portion 744*a*, and when the substrate 91 is mounted, the pressing portion 744*b* may press and fix the front surface of the substrate 91 by elastic force of the elastic portion 744*a*. That is, the substrate 91 may be restricted in downward and forward movement by the lower restriction portion 744.

In the state in which the lower portion of the substrate 91 is restricted, the substrate 91 may be in close contact with the support portion 741. When the substrate 91 is in close contact with the support portion 741, the substrate 91 may be maintained in the inclined state, and also, the rear surface of the substrate 91 may be in contact with the rear support portion 741*a*, and the upper and lower ends of the substrate 91 may be in contact with the upper support portion 741*b* by the lower support portion 741*c*, and thus, the substrate 91 may be disposed at an accurate position, and the substrate 91 may be maintained in the set inclination.

Here, the substrate 91 may be inclined so that the upper end faces a front side of the lower end, i.e., the front panel 61 and also may be disposed at a set angle $\alpha$. For example, the substrate 91 may be disposed to be inclined by an angle of approximately 15° with respect to the front panel 61. Here, the set angle may vary according to the arrangement height of the LED 92 and the distance between the LED 92 and the rear surface of the front panel 61, and the set angle may be determined so that a normal line of the front surface of the LED 92 passes through an area of the transmission portion 612.

When the substrate 91 is in in close contact with the display mounting portion 74 so as to be supported by the support portion 741, the upper end of the substrate 91 may be restricted by the upper restriction portion 745. The upper restriction portion 745 may protrude from the inclined portion 74*c* of the display mounting portion 74 and may be disposed to face a lower side as the upper restriction portion 745 protrudes so as to press the upper end of the substrate 91 from the upper side, thereby fixing the substrate without moving forward and upward.

The recessed space of the display mounting portion 74 may be defined by the bottom surface 74*a*, the rear surface 74*b*, and the inclined portion 74*c*. The bottom surface 74*a* may define a bottom surface inside the display mounting portion 74 and may extend to be perpendicular to the front surface of the lower frame 73 from the lower end of the opened front surface of the display mounting portion 74. The rear end of the bottom surface 74*a* may extend more backward than the lower end of the substrate 91.

In addition, the rear surface 74*b* extending upward may be disposed on a rear end of the bottom surface 74*a*. The rear surface 74*b* may extend to a height between the upper end and the lower end of the substrate 91. In addition, the inclined portion 74*c* may be disposed on an upper end of the rear surface 74*b*. The inclined portion 74*c* may obliquely extend from the upper end of the rear surface 74*b* to an upper end of the opened front surface of the display mounting portion 74.

An angle $\beta$ of the inclined portion 74*c* with respect to the front panel 61 may be greater than that of the substrate 91 (approximately 15°). That is, an extension line L1 of the substrate 91 and an extension line L2 of the inclined portion 74*c* may cross each other. Thus, the distance between the inclined portion 74*c* and the upper end of the substrate 91 may be reduced due to a difference in inclination. Thus, the upper restriction portion 745 may protrude from the inclined part 74*c* to restrict the upper end of the substrate 91.

Due to the structure of the inclined portion 74*c*, an upper space of the inner space of the display mounting portion 74 may be reduced, and thus, a space in which the insulating material 53 is further disposed may be provided to secure insulation performance.

In addition, since the angle of the inclined portion 74*c* is greater than the angle of the substrate 91, the upper restriction portion 745 protruding from the inclined portion 74*c* may not protrude excessively, and thus, the upper restriction portion 745 may be easily molded, and also, the upper restriction portion 745 may be prevented from being easily damaged during the mounting process of the display mounting portion 74.

In the state in which the upper and lower ends of the substrate are restricted by the upper restriction portion 745 and the lower restriction portion 744, respectively, the substrate 91 may be pushed to the left side so that a left end of the substrate 91 is in close contact with a left surface of the display mounting portion 74. In this state, the left end of the substrate 91 may be inserted between the side restriction portion 743 and the rear surface 74*b* of the display mounting portion 74.

When the left end of the substrate 91 is in close contact with the left surface of the display mounting portion 74, the coupling hole 911 of the substrate 91 may be supported by the coupling portion 742 so as to be aligned with each other. In this state, an operator may fix the right end of the substrate 91 to the coupling portion 742 by coupling the screw 746 to pass through the coupling hole 911.

The movement of the substrate 91 in the front and rear direction may be restricted by the side restriction portion 743 and the coupling portion 742.

As described above, the substrate 91 may be mounted to be sequentially restricted by the lower restriction portion 744, the upper restriction portion 745, the side restriction portion 743, and the coupling portion 742. In addition, the substrate 91 may be firmly fixed to the inside of the display mounting portion 74 by coupling the screw 746.

Since the substrate 91 is firmly fixed inside the display mounting portion 74, the substrate 91 may be maintained at its initial mounting position even when the door 50 is repeatedly opened and closed and is impacted during the opening and closing of the door 50. In addition, the light may be accurately irradiated to the transmission portion 612 so that the transmission portion 612 shines with set brightness.

Hereinafter, the operation of the display device 90 having the above structure will be described in detail with reference to drawings.

Figure 15:
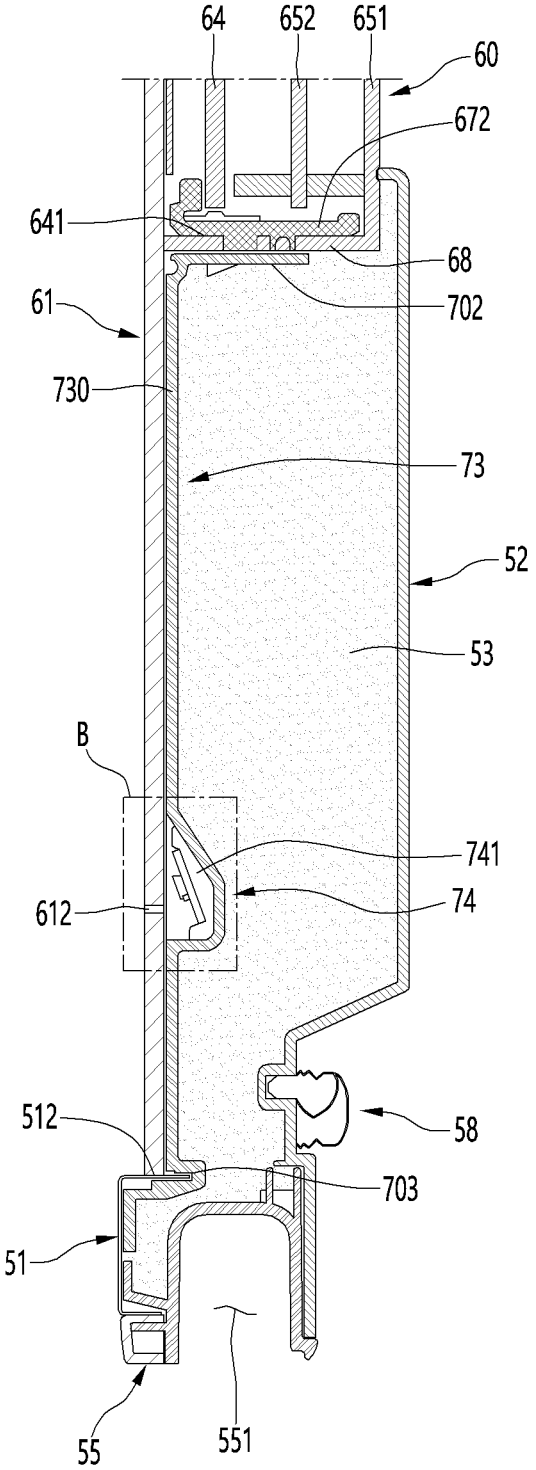
FIG. 15 is a cross-sectional view illustrating a lower end of the door.
Figure 16:
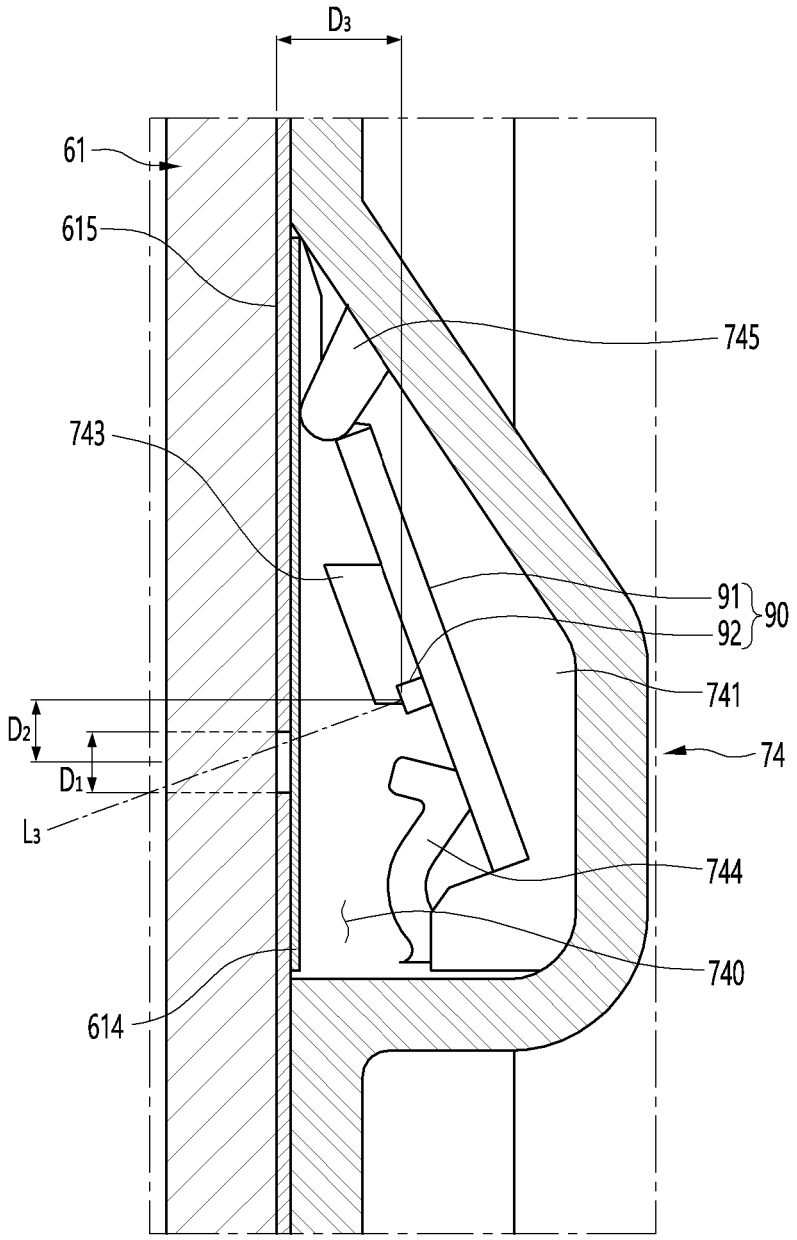
FIG. 16 is an enlarged view illustrating a portion B of FIG. 15.
Figure 17:
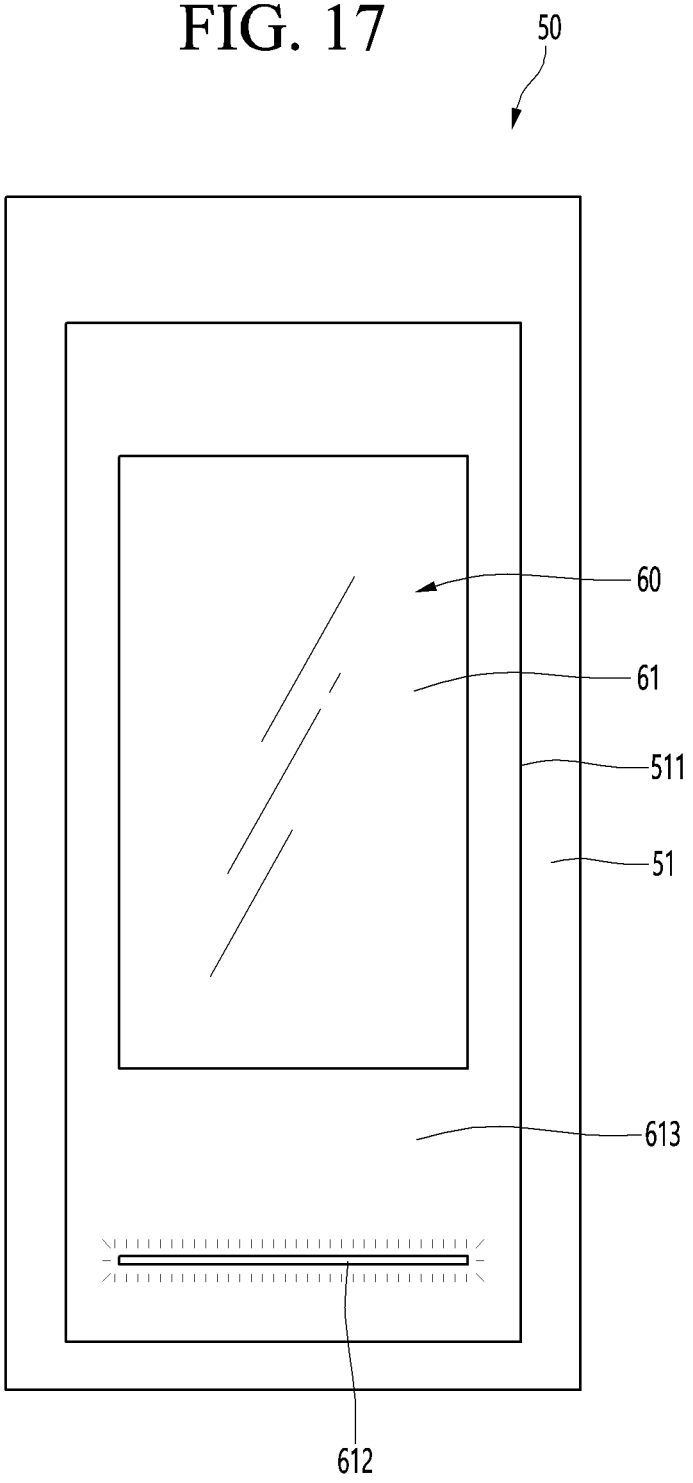
FIG. 17 is a view illustrating an output state of a transmission portion in the door.
Figure 18:
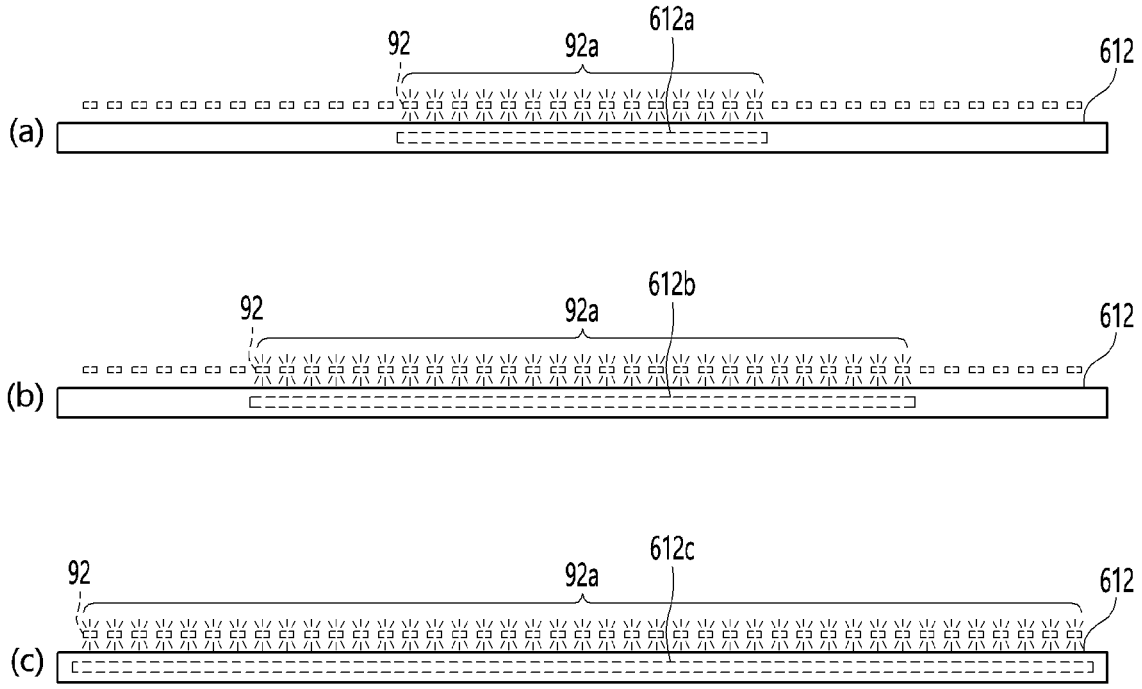
FIG. 18 is a view illustrating various example in state changes of the transmission portion.

FIG. 15 is a cross-sectional view illustrating the lower end of the door. In addition, FIG. 16 is an enlarged view illustrating a portion B of FIG. 15. In addition, FIG. 17 is a view illustrating an output state of the transmission portion in the door. In addition, FIG. 18 is a view illustrating various example in state changes of the transmission portion.

As illustrated in the drawings, in a state in which the sub door 50 is assembled, the display device 90 may be disposed inside the display mounting portion 74. When the LED 92 of the display device 90 is turned on, the light of the LED 92 may be irradiated toward the transmission portion 612, and the transmission portion 612 may shine by the light passing through the transmission portion 612 when viewed from the outside.

In addition, the LED 92 may be disposed higher than the transmission portion 612. Here, an extension line passing through a center of the transmission portion 612 may be disposed at the same position as an extension line passing through a center of the LED 92. For example, a set distance D2 may be approximately 3 mm and may be disposed in a state of being inclined toward the transmission portion 612. That is, the LED 92 may be substantially disposed on an area of the bezel portion 611 out of the transmission portion 612, and thus, even if the LED 92 is disposed close to the front panel 61, a phenomenon of light condensation may not occur at the position corresponding to the LED 92.

In addition, the substrate 91 may be disposed to be inclined at a set angle with respect to the front panel 61. Thus, even when the LED 92 is disposed higher than the transmission portion 612, the light may be effectively irradiated toward the transmission portion 612. That is, the substrate 91 may be disposed inclined at an angle so that a normal line L3 of the front surface of the LED 92 is directed toward the rear end of the transmission portion 612.

For example, a vertical width D2 of the transmission portion 612 may be about 2 mm. In addition, the center of the LED 92 may be spaced apart from the center of the transmission portion 612 upward by a set distance D2 of 3 mm. In addition, the substrate 91 may be inclined at an angle of about 15°, which is a set angle $\alpha$, to the front panel 61 so as to effectively radiate the light toward the transmission portion 612.

Due to the vertically spaced structure of the LED 92 and the transmission portion 612 and the inclined arrangement of the substrate 91, the distance between the LED 92 and the panel assembly 60 may be reduced, and also, the light condensation may be prevented from occurring in the transmission part 612.

For example, the distance between the transmission portion 612 and the LED 92 may be disposed very close to about 4 mm, which is a set distance D3, and thus, the brightness of the transmission portion 612 may be secured in the state in which the transmission portion 612 is LEDs 92 are vertically spaced apart from the transmission portion 612.

In addition, since the position of the LED 92 is closer than the panel assembly 60, a recessed depth of the display mounting portion 74 may be shallower to ensure a sufficient insulation distance inside the door 50. That is, due to the inclined arrangement of the display device 90, a sufficient thickness at which the insulation of the door 50 is satisfied may be secured.

Due to such an arrangement structure, the door 50 may satisfy the insulation, and at the same time, when the display device 90 operates so that information of the transmission portion 612 is displayed, the transmission portion 612 may shine in the form of the surface light without the light condensation phenomenon.

A bezel layer 615 may be disposed on the rear surface of the front panel 61 to prevent the light irradiated from the LED 92 from being transmitted to a portion other than the transmitting portion 612. The bezel layer 615 may be configured to block transmission of light and prevent the rear side of the front panel 61 from being visible. For example, the bezel layer 615 may be printed with a black color or provided by attaching a film, and an area of the bezel 613 may be defined by the bezel layer 615. Thus, only the area of the transmission portion 612 on which the bezel layer 615 is not formed may transmit the light irradiated from the LED 92.

Also, a diffusion sheet 614 may be attached to the rear surface of the front panel 61 corresponding to the transmission portion 612. The diffusion sheet 614 may be configured to shield the transmission portion 612 at the rear side. Thus, the light irradiated from the LED 92 may be transmitted through the diffusion sheet 614, and thus, the transmission portion 612 may be illuminated in the form of an overall surface light. That is, even when the light is irradiated in the state in which the LED 92 is disposed relatively close to the transmission portion 612, it is possible to prevent light from shining in the form of a spot due to the light condensation in the transmission portion 612.

The transmission portion 612 may be configured to be shined by the plurality of LEDs 92 and may be converted into various colors according to the operation of the LED 92. Thus, a specific color may be expressed according to an operation state of the refrigerator 1.

Also, the transmission portion 612 may partially turn on and off the LED 92 so that only a portion of the entire light is illuminated, and the operation state of the refrigerator including a temperature and time may be displayed in various patterns such as a bar graph or a bar shape in which a length varies.

Also, the transmission portion 612 may allow the LED 92 to be continuously turned on and off, thereby enabling a dynamic output. For example, the shining portion may be changed, or the length or color of the shining area may be continuously changed.

Also, the display device 90 may operate in conjunction with other components constituting the refrigerator 1. For example, when a specific screen is output from the display 63 in conjunction with the operation of the display 63, a specific pattern may be output together. Of course, the transmission portion 612 may independently output information when the display 63 is turned off. For example, when a voice signal is input by a microphone, which is provided at one side of the cabinet or door to receives a user's voice, or a sound is output by a speaker for outputting operation conditions or information of the refrigerator, the transmission portion 612 may visualize the voice signal or the sound in response thereto to visualize the state of the voice input or sound output to the user.

The variable light emission pattern of the display device 90 may indicate that at least one or more of the number of LEDs 92 that are turned on, the position of the LED 92 that are turned on, the light emission intensity and color of the LED 90 that are turned on vary.

Looking at an example of a change in the light emitting pattern of the display device, as illustrated in FIG. 18, the display device may display a different pattern according to the intensity or volume of the sound input through the microphone to accurately input the user's voice.

For example, referring to FIG. 15, a sound intensity may be divided into a plurality of levels.

When the sound intensity corresponds to a first level, a first group 92*a* constituted by some of the plurality of LEDs 92 may be turned on so that a first area 612*a* of the see-through portion 611 shines in the form of the surface light.

In addition, when the sound intensity corresponds to a second level greater than the first level, a second group 92*b* constituted by more LEDS 92 than those of the first group 92*a* may be turned on so that a second area 612*b* of the see-through portion 611, which is longer than the first area 612*a*, shines in the form of the surface light.

In addition, when the sound intensity corresponds to a third level greater than the second level, a third group 92*c* constituted by more LEDS 92 than those of the second group 92*b* may be turned on so that a third area 612*c* of the see-through portion 611, which is longer than the second area 612*b*, shines in the form of the surface light. Here, the third area 612*c* may be an entire area of the see-through portion 611.

In FIG. 18, as an example, the variation of the emission pattern of the see-through portion 611 when divided into three levels has been described, but the level division of the sound intensity is not limited thereto.

In addition, although the first group 92*a* is set to, for example, the LEDs 92 disposed at the central portion among the plurality of LEDs 92, the position of the LEDs that are turned on may vary. For example, when the intensity of the sound is the first level, N LEDs may be turned on from the LEDs 92 disposed at the left or right end. When the sound intensity is the second level, M LEDs may be turned on from the LEDs disposed at the left or right end.

For another example, the same number of LEDs that are turned on may be maintained, and the color or intensity of each of the LEDs that are turned on may vary according to the sound intensity.

Although the structure in which the panel assembly 60 and the display device 90 are provided in the sub door is described as the embodiments, this structure may be equally applied to a single type refrigerating or freezing compartment door.

INDUSTRIAL APPLICABILITY

The refrigerator according to an embodiment has the improved convenience of use due to the arrangement of the see-through portion, and thus industrial applicability is high.

What is claimed is:

1. A refrigerator comprising:

a cabinet having a storage space; and a door configured to open and close the storage space, and an insulating material is provided within the door, wherein the door comprises:

an outer plate configured to define a front of the door, and the outer plate having an opening;

a panel assembly configured to shield the opening and selectively allow inside of the door to be seen therethrough;

a supporter frame mounted on a rear of the outer plate, and the supporter frame is configured to support a circumference of the opening and a circumference of the panel assembly; and a display device mounted on the supporter frame, the display device including a substrate and a plurality of light emitting devices (LEDs) disposed on the substrate, wherein the panel assembly includes a transmission portion through which light from the display device is irradiated, and wherein the LEDs are spaced apart from the transmission portion, and the LEDs are inclined with respect to a front surface of the panel assembly to irradiate light toward the transmission portion.

2. The refrigerator according to claim 1, wherein the LEDs are disposed above the transmission portion, and wherein the LEDs are mounted such that a normal line of a front surface of each of the LEDs is to pass through the transmission portion.

3. The refrigerator according to claim 1, wherein the supporter frame includes a display mount that is recessed to accommodate the display device, and the panel assembly is configured to shield the display mount.

4. The refrigerator according to claim 3, wherein the display mount includes an inclined mount portion configured to protrude backward as the inclined mount portion extends downward, and an inclination of the inclined mount portion is greater than an inclination of the substrate.

5. The refrigerator according to claim 4, wherein the display mount includes a vertical mount portion configured to extend up to a lower end of the inclined mount portion, and the vertical mount portion is parallel to a front surface of the panel assembly.

6. The refrigerator according to claim 3, wherein the display mount includes a substrate support configured to support the substrate, and wherein the substrate support comprises:

a rear support configured to support a rear surface of the substrate such that an inclination of the rear support is equal to the inclination of the substrate;

an upper support to protrude forward from an upper end of the rear support, and configured to restrict an upper end of the substrate; and a lower support to protrude forward from a lower end of the rear support, and configured to support a lower end of the substrate.

7. The refrigerator according to claim 3, wherein the display mount includes a lower restriction that protrudes from the substrate and is bent to press and fix to a front surface of the display mount.

8. The refrigerator according to claim 7, wherein the lower restriction is opened upward to receive a lower end of the substrate, and wherein the display mount includes an upper restriction that protrudes downward, and is configured to restrict an upper end of the substrate.

9. The refrigerator according to claim 3, wherein the display mount includes:

a coupler configured to pass through a coupling hole of the substrate and support a first end of the substrate; and a side restriction configured to protrude from a second end of the substrate and configured to restrict the second end of the substrate.

10. The refrigerator according to claim 1, wherein the door comprises:

a main door configured to open and close the storage space, and to define a main door opening; and a sub door configured to open and close the main door opening at a front of the main door, wherein the outer plate is configured to define a front of the sub door, and the panel assembly is provided on the sub door.

11. The refrigerator according to claim 1, wherein the panel assembly comprises:

a front panel configured to define a front of the panel assembly and to shield the opening at the outer plate;

a rear panel spaced apart from the front panel to provide a space for a display, and the rear panel is configured to define a rear of the front panel; and an outer frame to connect the front panel to the rear panel, and configured to define a circumference of the panel assembly, and wherein the front panel is larger than the rear panel such that a portion of the front panel protruding to outside of the outer frame is configured to shield a front of the display device.

12. The refrigerator according to claim 11, wherein the front panel is made of a glass material, a bezel disposed on a rear of the front panel, and the transmission portion is disposed on the front panel at an area on which the bezel is not disposed.

13. The refrigerator according to claim 11, wherein the supporter frame includes a display mount that is recessed to accommodate the display device, and a rear of the front panel is in contact with a front of the supporter frame and is configured to define a closed space in the display mount.

14. The refrigerator according to claim 11, wherein a diffusion sheet shields the transmission portion, and the diffusion sheet is configured to diffuse the light irradiated from the LEDs.

15. A refrigerator comprising:

a cabinet having a storage space; and a main door configured to open and close the storage space, and to define a main door opening;

a sub door configured to open and close the main door opening, wherein the sub door comprises:

an outer plate configured to define a front of the sub door, and the outer plate having an opening;

a panel assembly configured to selectively allow inside of the main door to be seen therethrough, and including a main display to selectively output an image;

a supporter frame mounted on a rear of the outer plate, and the supporter frame is configured to support the opening of the outer plate and the panel assembly; and a display device mounted on the supporter frame, the display device including a substrate and a plurality of light emitting devices (LEDs) disposed on the substrate, wherein the panel assembly includes an auxiliary display through which light from the display device is irradiated, and the auxiliary display is spaced apart from the main display, and wherein the LEDs are spaced apart from the auxiliary display, and the LEDs are inclined with respect to a front surface of the panel assembly to irradiate light toward the auxiliary display.

16. The refrigerator according to claim 15, wherein the supporter frame includes a display mount that is recessed to accommodate the display device, wherein the display mount includes a substrate support configured to support the substrate, and wherein the substrate support includes:

a rear support configured to support a rear surface of the substrate such that an inclination of the rear support is equal to the inclination of the substrate;

an upper support to protrude forward from an upper end of the rear support, and configured to restrict an upper end of the substrate; and a lower support to protrude forward from a lower end of the rear support, and configured to support a lower end of the substrate.

17. The refrigerator according to claim 16, wherein the panel assembly comprises:

a front panel configured to define a front of the panel assembly and to shield the opening of the outer plate;

a rear panel spaced apart from the front panel to provide a space for the main display, and the rear panel is configured to define a rear of the panel assembly; and an outer frame to connect the front panel to the rear panel, and configured to define a circumference of the panel assembly, wherein the front panel is made of a glass material, and a bezel disposed on a rear of the front panel, and the auxiliary display is disposed on the front panel at an area on which the bezel is not disposed.

18. A refrigerator comprising:

a cabinet having a storage space; and a door configured to open and close the storage space, wherein the door comprises:

an outer plate configured to define a front of the door, and the outer plate having an opening;

a panel assembly having a transparent display to selectively be visible or display an image;

a supporter frame mounted on a rear of the outer plate, and the supporter frame is configured to support the outer plate and the panel assembly; and a display device mounted on the supporter frame, the display device including a substrate and a plurality of light emitting devices (LEDs) disposed on the substrate, wherein a bar-shaped transmission portion is provided in the door and is configured such that light from the display device is irradiated from the door, wherein the supporter frame includes a display mount that is recessed to accommodate the display device, and wherein the LEDs are spaced apart from the transmission portion, and the LEDs are inclined with respect to a front surface of the panel assembly to irradiate light toward the transmission portion.

19. The refrigerator according to claim 18, wherein the display mount includes a substrate support configured to support the substrate, wherein the substrate support includes:

a rear support configured to support a rear surface of the substrate such that an inclination of the rear support is equal to the inclination of the substrate;

an upper support to protrude forward from an upper end of the rear support, and configured to restrict an upper end of the substrate; and a lower support to protrude forward from a lower end of the rear support, and configured to support a lower end of the substrate.

* * * * *